US011364733B2

(12) United States Patent
Ishimoto et al.

(10) Patent No.: US 11,364,733 B2
(45) Date of Patent: Jun. 21, 2022

(54) INK RIBBON FEEDING MECHANISM AND TAPE PRINTING APPARATUS

(71) Applicant: SEIKO EPSON CORPORATION, Tokyo (JP)

(72) Inventors: Akio Ishimoto, Shiojiri (JP); Taishi Sasaki, Matsumoto (JP); Tomoyuki Kubota, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 230 days.

(21) Appl. No.: 16/881,215

(22) Filed: May 22, 2020

(65) Prior Publication Data

US 2020/0369059 A1 Nov. 26, 2020

(30) Foreign Application Priority Data

May 23, 2019 (JP) ..... JP2019-096554

(51) Int. Cl.
*B41J 32/02* (2006.01)

(52) U.S. Cl.
CPC ..... *B41J 32/02* (2013.01)

(58) Field of Classification Search
CPC ..... B41J 32/00; B41J 32/02; B41J 33/16
See application file for complete search history.

(56) References Cited

U.S. PATENT DOCUMENTS

| | | | | |
|---|---|---|---|---|
| 6,042,038 | A | 3/2000 | Shiraishi | |
| 6,145,769 | A | 11/2000 | Shiraishi et al. | |
| 2011/0036501 | A1* | 2/2011 | Sakano | B41J 3/4075 156/350 |
| 2018/0079239 | A1* | 3/2018 | Sasaki | B41J 15/04 |

FOREIGN PATENT DOCUMENTS

| | | | | |
|---|---|---|---|---|
| EP | 3388245 | A1 * | 10/2018 | B41J 15/042 |
| JP | H08-039912 | A | 2/1996 | |
| JP | H10-086494 | A | 4/1998 | |
| JP | 2001-047714 | A | 2/2001 | |
| JP | 2002-225372 | A | 8/2002 | |

* cited by examiner

*Primary Examiner* — Kristal Feggins
(74) *Attorney, Agent, or Firm* — Oliff PLC

(57) ABSTRACT

An ink ribbon feeding mechanism includes a cartridge mounting section, a first paying out rotor which is inserted into a first paying out core when a cartridge is being mounted in the cartridge mounting section, and a plurality of rotor side engaging portions which are provided on the first paying out rotor and which engage with a plurality of core side engaging portions when the first paying out rotor rotates. The rotor side engaging portion has an butting portion. When the cartridge is being mounted in the cartridge mounting section, the core side engaging portion butts against the butting portion, one or the other of the first paying out core and the first paying out rotor rotates, the rotor side engaging portion is inserted into the core side insertion recessed portion. A plurality of the butting portions are provided in positions different from each other in a cartridge mounting direction.

6 Claims, 23 Drawing Sheets

INK RIBBON FEEDING MECHANISM AND TAPE PRINTING APPARATUS

The present application is based on, and claims priority from JP Application Serial Number 2019-096554, filed May 23, 2019, the disclosure of which is hereby incorporated by reference herein in its entirety.

BACKGROUND

1. Technical Field

The present disclosure relates to an ink ribbon feeding mechanism that feeds an ink ribbon and a tape printing apparatus.

2. Related Art

As disclosed in JP-A-2002-225372, a ribbon winding mechanism has been known which includes a cartridge mounting unit where a ribbon cartridge including a winding core is mounted and a winding bobbin which is provided in the cartridge mounting unit. The winding bobbin is provided with a plurality of bobbin side ribs. The bobbin side rib is inserted between a plurality of core side ribs provided to the winding core when the ribbon cartridge is mounted in the cartridge mounting unit, and engages with the core side rib when the winding bobbin rotates.

In an existing ribbon winding mechanism, tip portions of a plurality of bobbin side ribs are provided in the same position in a mounting direction. Therefore, when the ribbon cartridge is being mounted in the cartridge mounting unit, a plurality of core side ribs may abut against the tip portions of a plurality of bobbin side ribs at the same time. In this case, a state occurs in which one of the winding bobbin and the winding core cannot rotate with respect to the other, and the bobbin side rib is not inserted between the core side ribs, so that there is a risk that a user cannot smoothly mount the ribbon cartridge.

SUMMARY

The ink ribbon feeding mechanism of the present disclosure includes a cartridge mounting section where a cartridge including a paying out core around which an ink ribbon is wound and in which a plurality of core side engaging portions and a plurality of core side insertion recessed portions are alternately provided in a circumferential direction is mounted, a paying out shaft provided in the cartridge mounting section, a paying out rotor which is rotatably provided to the paying out shaft and is inserted into the paying out core when the cartridge is being mounted in the cartridge mounting section, and a plurality of rotor side engaging portions which are provided on an outer circumferential surface of the paying out rotor so as to protrude in a radial direction and which engage with the plurality of core side engaging portions when the paying out rotor rotates. The plurality of rotor side engaging portions have an butting portion provided in an opposite direction of a mounting direction of the cartridge, and when the cartridge is being mounted in the cartridge mounting section, if the core side engaging portion provided in the mounting direction of the cartridge butts against the butting portion, one of the paying out core and the paying out rotor rotates with respect to the other, so that the rotor side engaging portion is inserted into the core side insertion recessed portion. A plurality of the butting portions are provided in positions different from each other in the mounting direction of the cartridge.

The tape printing apparatus of the present disclosure includes a cartridge mounting section where a cartridge including a paying out core around which an ink ribbon is wound and in which a plurality of core side engaging portions and a plurality of core side insertion recessed portions are alternately provided in a circumferential direction is mounted, a paying out shaft provided in the cartridge mounting section, a paying out rotor which is rotatably provided to the paying out shaft and is inserted into the paying out core when the cartridge is being mounted in the cartridge mounting section, a plurality of rotor side engaging portions which are provided on an outer circumferential surface of the paying out rotor so as to protrude in a radial direction and which engage with the plurality of core side engaging portions when the paying out rotor rotates, and a print head that holds the ink ribbon and a print tape between the print head and a platen roller and performs printing on the print tape. The plurality of rotor side engaging portions have an butting portion provided in an opposite direction of a mounting direction of the cartridge, and when the cartridge is being mounted in the cartridge mounting section, if the core side engaging portion provided in the mounting direction of the cartridge butts against the butting portion. A plurality of the butting portions are provided in positions different from each other in the mounting direction of the cartridge.

DESCRIPTION OF EXEMPLARY EMBODIMENTS

Figure 1:
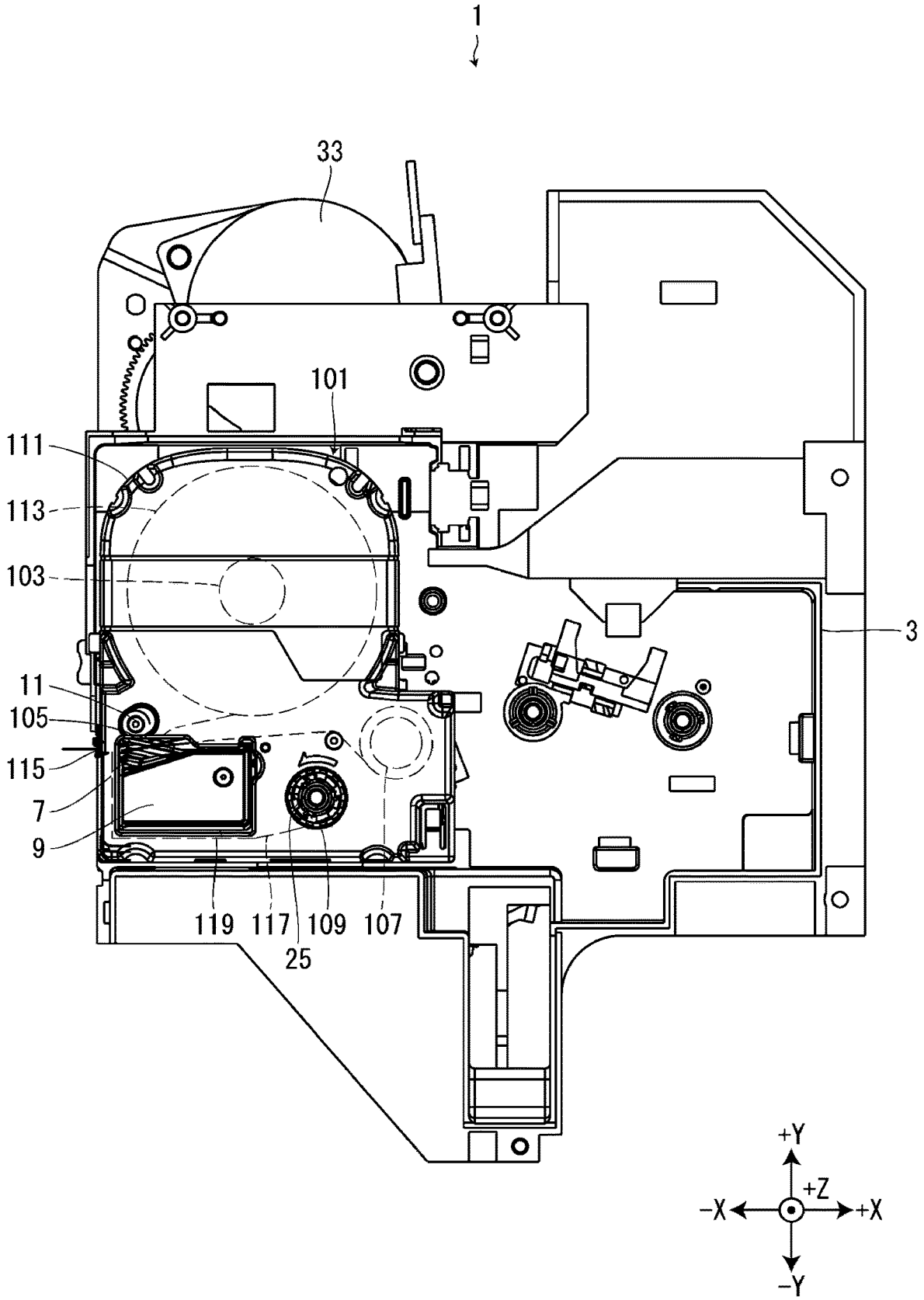
FIG. 1 is a diagram of a tape printing apparatus, in a state in which a tape cartridge is mounted in a cartridge mounting section, viewed from a +Z side.

Hereinafter, embodiments of an ink ribbon feeding mechanism and a tape printing apparatus will be described with reference to the accompanying drawings. Although an XYZ orthogonal coordinate system is shown in the drawings below, the XYZ orthogonal coordinate system is used only for convenience of description and does not limit at all the embodiments described below. Numerical numbers representing the numbers of components and the like are merely examples and do not limit at all the embodiments described below.

First Embodiment

Figure 3:
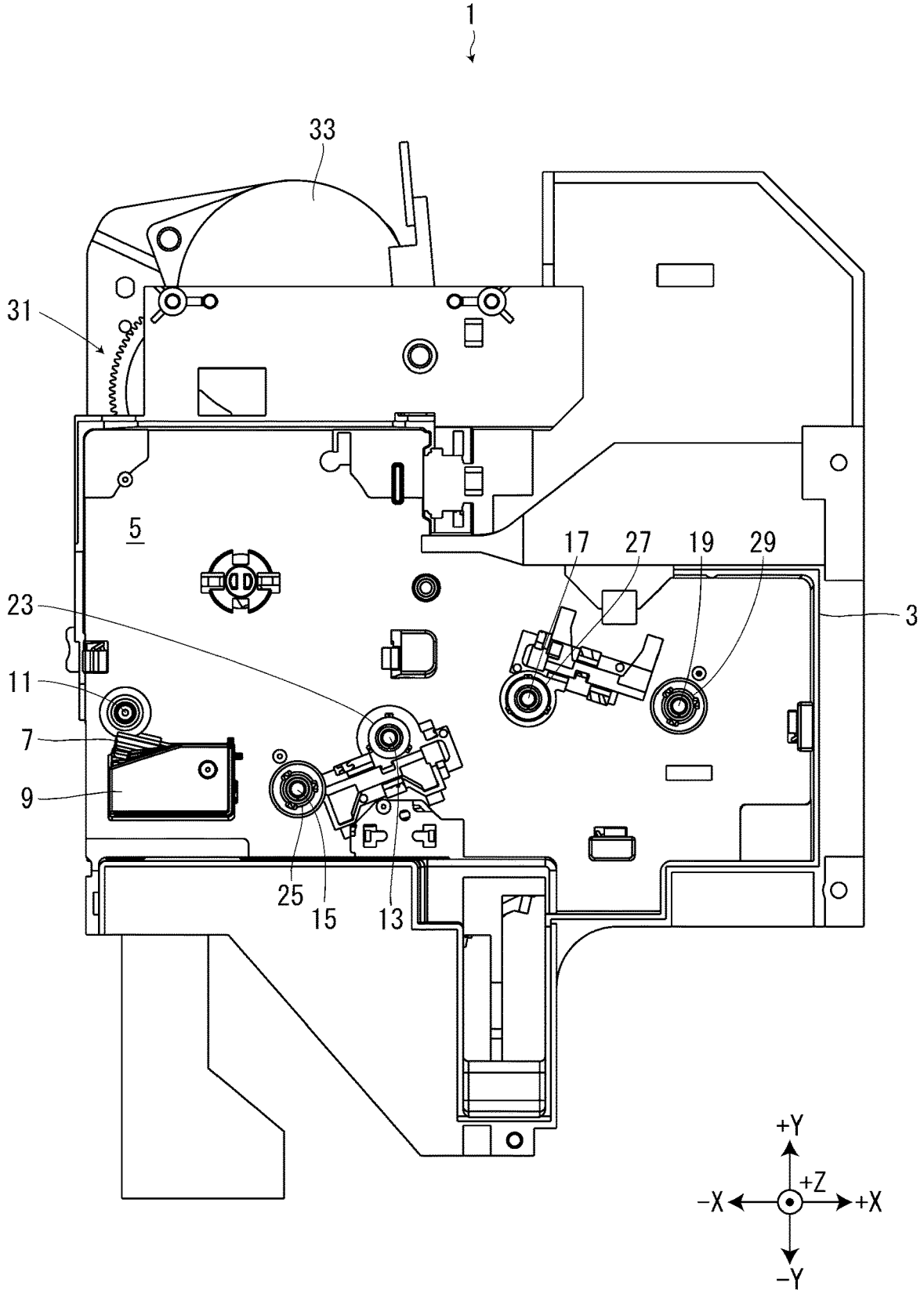
FIG. 3 is a diagram of the tape printing apparatus, in a state in which neither the tape cartridge nor the ribbon cartridge is mounted in the cartridge mounting section, viewed from the +Z side.

As shown in FIGS. 1 and 3, a tape printing apparatus 1 of the first embodiment includes a cartridge mounting section 3 where a tape cartridge 101 and a ribbon cartridge 201 are alternatively mounted. Although not shown in the drawings, the tape printing apparatus 1 includes a mounting section cover that opens and closes the cartridge mounting section 3.

As shown in FIG. 1, the tape cartridge 101 includes a tape core 103, a first platen roller 105, a first paying out core 107, a first winding core 109, and a first cartridge case 111 that stores them. A first print tape 113 is wound around the tape core 103. The first print tape 113 fed out from the tape core 103 is sent out to the outside of the first cartridge case 111 from a tape outlet port 115 provided in a circumferential wall portion on the −X side of the first cartridge case 111. A first ink ribbon 117 is wound around the first paying out core 107. The first ink ribbon 117 fed out from the first paying out core 107 is wound onto the first winding core 109. The first cartridge case 111 is provided with a first head insertion hole 119 penetrating in the Z direction.

Figure 2:
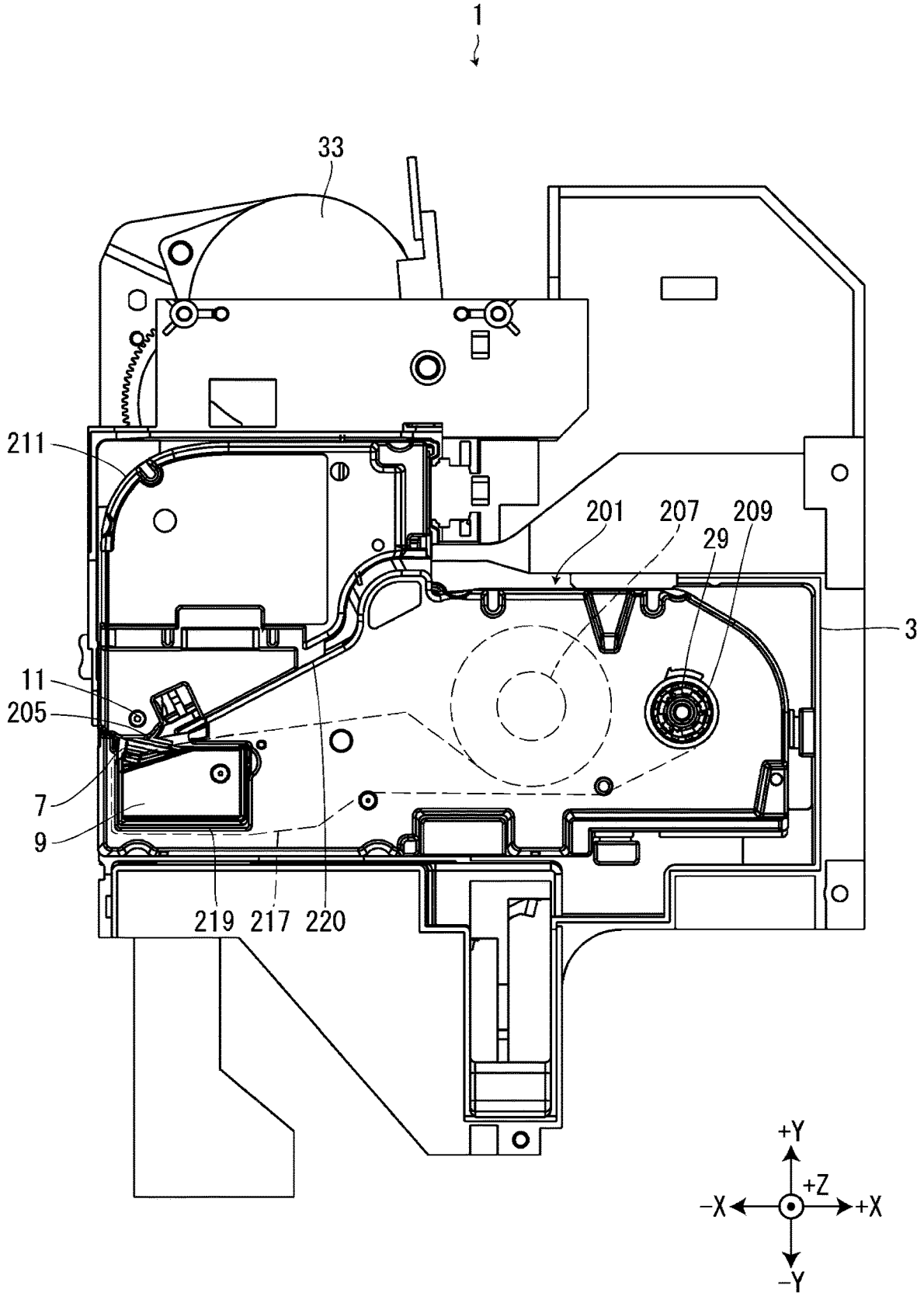
FIG. 2 is a diagram of the tape printing apparatus, in a state in which a ribbon cartridge is mounted in the cartridge mounting section, viewed from the +Z side.

As shown in FIG. 2, the ribbon cartridge 201 includes, a second platen roller 205, a second paying out core 207, a second winding core 209, and a second cartridge case 211 that stores them. A second ink ribbon 217 is wound around the second paying out core 207. The second ink ribbon 217 fed out from the second paying out core 207 is wound onto the second winding core 209. The second cartridge case 211 is provided with a second head insertion hole 219 penetrating in the Z direction. The second cartridge case 211 is provided with a second tape path 220. Although not shown in the drawings, a second print tape fed out from a tape roll provided outside the tape printing apparatus 1 is introduced to the second tape path 220.

Although the length of the second print tape in the tape roll in an unused state and the length of the second ink ribbon 217 stored in the ribbon cartridge 201 in an unused state are not particularly limited, in the present embodiment, they are longer than the length of the first print tape 113 stored in the tape cartridge 101 in an unused state and the length of the first ink ribbon 117, respectively. Therefore, for example, when a large number of labels are created, the ribbon cartridge 201 is mounted in the cartridge mounting section 3.

Figure 4:
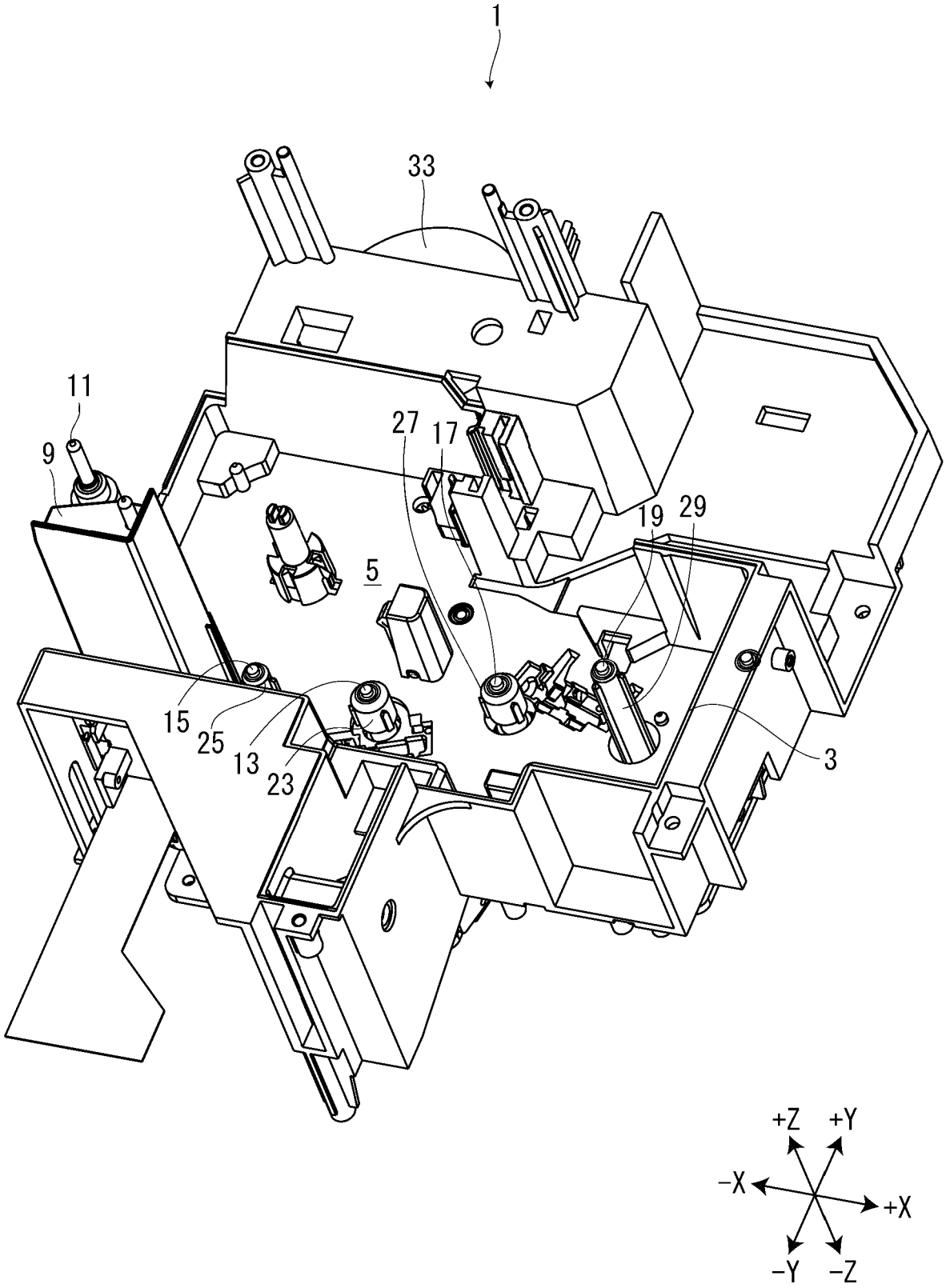
FIG. 4 is a perspective view of the tape printing apparatus, in a state in which neither the tape cartridge nor the ribbon cartridge is mounted in the cartridge mounting section.

As shown in FIGS. 3 and 4, the cartridge mounting section 3 is formed into a recessed shape whose +Z side is opened. On a mounting bottom surface 5, which is a bottom surface (−Z side surface) of the cartridge mounting section 3, a print head 7 and a head cover 9 are provided so as to protrude to the +Z side. The print head 7 is a thermal head including heating elements. The head cover 9 covers a part of the print head 7. When the tape cartridge 101 is being mounted in the cartridge mounting section 3 the head cover 9 is inserted into the first head insertion hole 119 (see FIG. 1) and guides the mounting of the tape cartridge 101. When the ribbon cartridge 201 is being mounted in the cartridge mounting section 3, the head cover 9 is inserted into the second head insertion hole 219 (see FIG. 2) and guides the mounting of the ribbon cartridge 201.

On the mounting bottom surface 5, in order from the −X side, a platen shaft 11, a first winding shaft 15, a first paying out shaft 13, a second paying out shaft 17, and a second winding shaft 19 are provided so as to protrude to the +Z side.

The platen shaft 11 is provided on the +Y side of the print head 7. The platen shaft 11 protrudes to the +Z side more than the first paying out shaft 13, the first winding shaft 15, the second paying out shaft 17, and the second winding shaft 19. When the tape cartridge 101 is being mounted in the cartridge mounting section 3 the platen shaft 11 is inserted into the first platen roller 105 (see FIG. 1) and guides the mounting of the tape cartridge 101 along with the head cover 9. When the ribbon cartridge 201 is being mounted in the cartridge mounting section 3, the platen shaft 11 is inserted into the second platen roller 205 (see FIG. 2) and guides the mounting of the ribbon cartridge 201 along with the head cover 9. A mounting direction means a mounting direction of the tape cartridge 101 or a mounting direction of the ribbon cartridge 201. The mounting direction is parallel to a direction in which the platen shaft 11 extends, that is, the Z direction. The opposite direction of the mounting direction means the +Z side, and the mounting direction means the −Z side.

A platen rotor (not shown in the drawings), a first paying out rotor 23, a first winding rotor 25, a second paying out rotor 27, and a second winding rotor 29 are rotatably supported by the platen shaft 11, the first paying out shaft 13, the first winding shaft 15, the second paying out shaft 17, and the second winding shaft 19, respectively. A rotation of a feed motor 33 is transmitted to the platen rotor, the first paying out rotor 23, the first winding rotor 25, the second paying out rotor 27, and the second winding rotor 29 through a feed wheel row 31.

Here, print processing performed by the tape printing apparatus 1 when the tape cartridge 101 is mounted in the cartridge mounting section 3 will be described. As shown in FIG. 1, when tape cartridge 101 is mounted in the cartridge mounting section 3, the platen rotor, the first paying out rotor 23, and the first winding rotor 25 are inserted into the first platen roller 105, the first paying out core 107, and the first winding core 109, respectively. When the mounting section cover is closed after the tape cartridge 101 is mounted in the cartridge mounting section 3, the print head 7 is moved toward the platen shaft 11 by a head moving mechanism not shown in the drawings. Thereby, the first print tape 113 and the first ink ribbon 117 are held between the print head 7 and the first platen roller 105.

In this state, when the feed motor 33 rotates in a first direction, the first platen roller 105 rotates clockwise and the first winding core 109 rotates counterclockwise as viewed from the mounting direction. Thereby, the first print tape 113 is sent toward a tape discharge port (not shown in the drawings) provided on the −X side of the cartridge mounting section 3 and the first ink ribbon 117 is wound onto the first winding core 109. At this time, the print head 7 generates heat, so that print information inputted from a keyboard or the like is printed on the first print tape 113.

Although a printed portion of the first print tape 113 is not shown in the drawings, the printed portion is cut and separated by a cutter provided between the cartridge mounting section 3 and the tape discharge port. Thereafter, when the feed motor 33 rotates in a second direction opposite to the first direction, the first platen roller 105 rotates counterclockwise and the first paying out core 107 rotates counterclockwise as viewed from the mounting direction. Thereby, the first print tape 113 is pulled back until a tip of the first print tape 113 comes close to a position held between the print head 7 and the first platen roller 105. Therefore, it is possible to reduce a blank space generated in a front area in the length direction of the first print tape 113 to be printed next.

Subsequently, print processing performed by the tape printing apparatus 1 when the ribbon cartridge 201 is mounted in the cartridge mounting section 3 will be described. When the ribbon cartridge 201 is mounted, the tape printing apparatus 1 also performs print processing in the same manner as when the tape cartridge 101 is mounted. Specifically, as shown in FIG. 2, when ribbon cartridge 201 is mounted in the cartridge mounting section 3, the platen rotor, the second paying out rotor 27, and the second winding rotor 29 are inserted into the second platen roller 205, the second paying out core 207, and the second winding core 209, respectively. When the mounting section cover is closed after the ribbon cartridge 201 is mounted in the cartridge mounting section 3, the print head 7 is moved toward the platen shaft 11 by the head moving mechanism. Thereby, the second print tape and the second ink ribbon 217 are held between the print head 7 and the second platen roller 205.

In this state, when the feed motor 33 rotates in the first direction, the second platen roller 205 rotates clockwise and the second winding core 209 rotates counterclockwise as viewed from the mounting direction. Thereby, the second print tape is sent toward the tape discharge port and the second ink ribbon 217 is wound onto the second winding core 209. At this time, the print head 7 generates heat, so that print information inputted from the keyboard or the like is printed on the second print tape.

A printed portion of the second print tape is cut and separated by the cutter. Thereafter, when the feed motor 33 rotates in the second direction, the second platen roller 205 rotates clockwise and the second paying out core 207 rotates counterclockwise as viewed from the mounting direction. Thereby, the second print tape is pulled back until a tip of the second print tape comes close to a position held between the print head 7 and the second platen roller 205. Therefore, it is possible to reduce a blank space generated in a front area in the length direction of the second print tape to be printed next.

A mechanism including the cartridge mounting section 3, the first paying out shaft 13, the second paying out shaft 17, the first paying out rotor 23, and the second paying out rotor 27 is an example of an "ink ribbon feeding mechanism".

Figure 5:
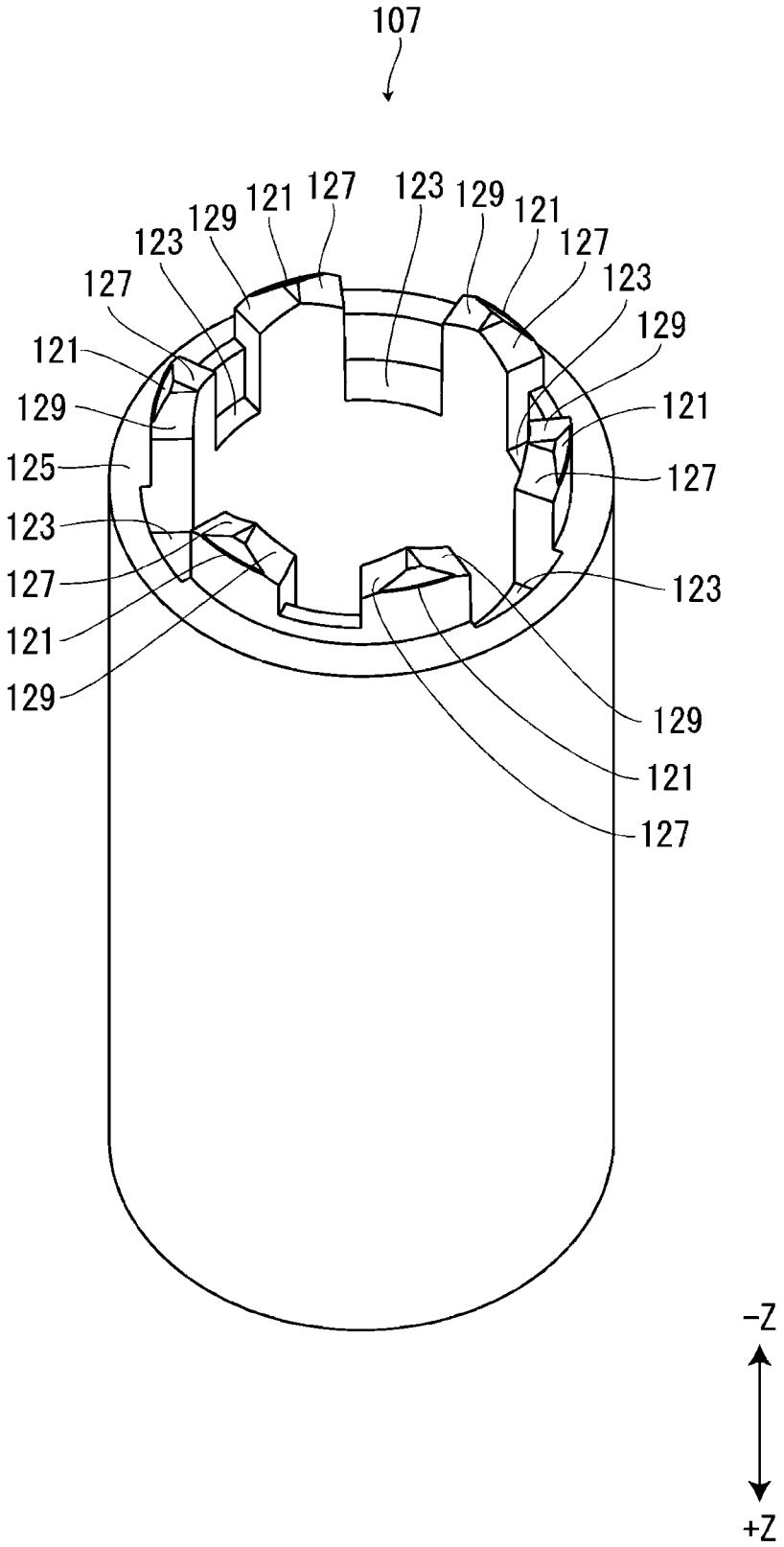
FIG. 5 is a perspective view of a first paying out core.
Figure 6:
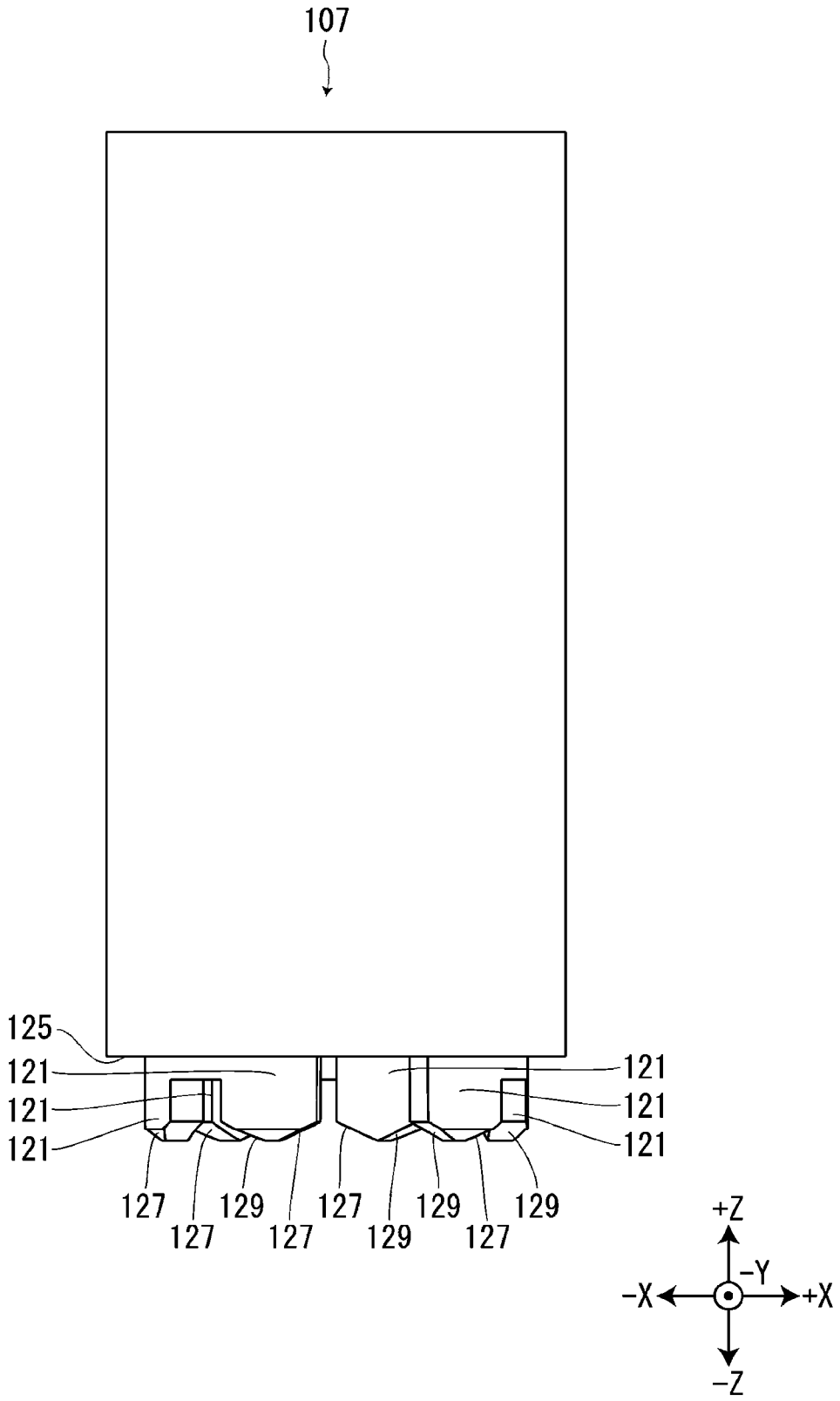
FIG. 6 is a diagram of the first paying out core viewed from a −Y side.
Figure 7:
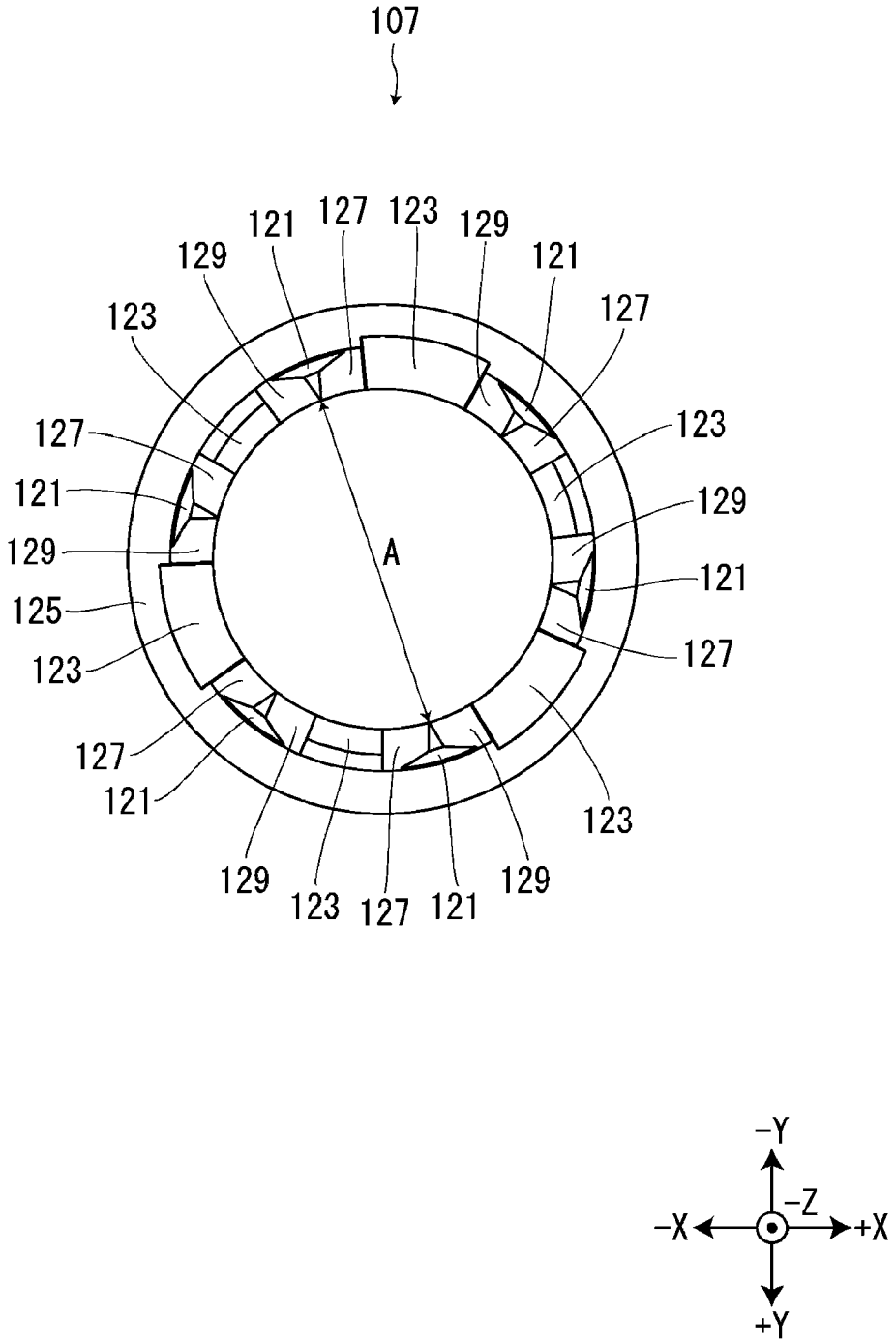
FIG. 7 is a diagram of the first paying out core viewed from a −Z side.

The first paying out core 107 will be described with reference to FIGS. 5 to 7. The first paying out core 107 and the second paying out core 207 are configured in the same manner, so that the first paying out core 107 will be representatively described. The first paying out core 107 is formed into a substantially cylindrical shape, and an inner circumferential surface of an end portion in the mounting direction is provided with six core side engaging portions 121 and six core side insertion recessed portions 123. The core side engaging portions 121 and the core side insertion recessed portions 123 are alternately provided in a circumferential direction of the first paying out core 107. The core side engaging portion 121 is provided so as to protrude in the mounting direction from a lower side end surface 125 which is an end surface in the mounting direction of the first paying out core 107, and the core side insertion recessed portion 123 is provided to recess in the opposite direction of the mounting direction from the lower side end surface 125. The protrusion heights of the six core side engaging portions 121, that is, the dimensions in the mounting direction of the six core side engaging portions 121, are substantially the same (see FIG. 6).

An end portion in the mounting direction of the core side engaging portion 121 is provided with a first engaging inclined surface 127 and a second engaging inclined surface 129. The first engaging inclined surface 127 is provided on a front portion of the end portion in the clockwise direction as viewed from the opposite direction of the mounting direction, and the second engaging inclined surface 129 is provided on a rear portion of the end portion in the clockwise direction as viewed from the opposite direction of the mounting direction. The first engaging inclined surface 127 is formed on an inclined surface whose end portion facing the core side insertion recessed portion 123 is in the opposite direction of the mounting direction. In the same manner, the second inclined surface 129 is formed on an inclined surface whose end portion facing the core side insertion recessed portion 123 is in the opposite direction of the mounting direction.

Figure 8:
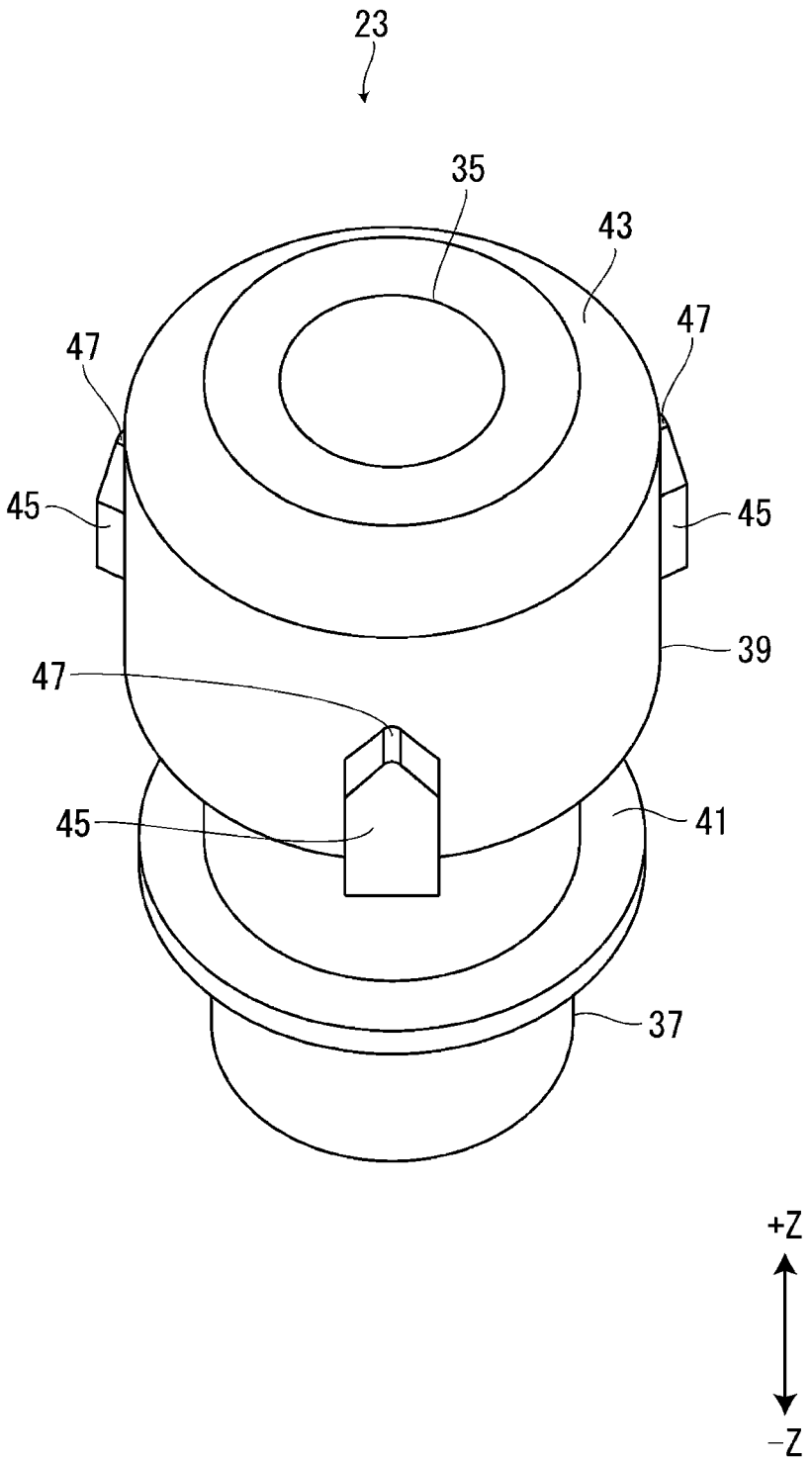
FIG. 8 is a perspective view of a first paying out rotor.

The first paying out rotor 23 will be described with reference to FIGS. 8 to 10. The first paying out rotor 23 and the second paying out rotor 27 are configured in the same manner, so that the first paying out rotor 23 will be representatively described. The first paying out rotor 23 is provided with a shaft insertion hole 35 penetrating in the Z direction. The first paying out shaft 13 is inserted into the shaft insertion hole 35. The first paying out rotor 23 includes a small diameter portion 37 in the mounting direction and a large diameter portion 39 in the opposite direction of the mounting direction. The small diameter portion 37 is formed into a substantially cylindrical shape and is provided with a flange portion 41 in a substantially middle portion in the mounting direction.

The large diameter portion 39 is formed into a substantially cylindrical shape whose diameter is larger than that of the small diameter portion 37. The large diameter portion 39 has a chamfered portion 43 formed by chamfering a corner portion in the opposite direction of the mounting direction. Thereby, When the tape cartridge 101 is being mounted in the cartridge mounting section 3 the large diameter portion 39 is smoothly inserted into the first paying out core 107.

On an outer circumferential surface of the large diameter portion 39, three rotor side engaging portions 45 are provided so as to protrude in a radial direction. The three rotor side engaging portions 45 are provided at substantially equal intervals in a circumferential direction of the first paying out rotor 23. The rotor side engaging portion 45 extends in the opposite direction of the mounting direction from an end portion in the mounting direction of the large diameter portion 39. The rotor side engaging portion 45 has an butting portion 47 provided at an end portion in the opposite direction of the mounting direction. In other words, the end portion in the opposite direction of the mounting direction of the rotor side engaging portion 45 is formed into a substantially mountain shape as viewed from the outside in the radial direction of the first paying out rotor 23 and a portion corresponding to a crest portion of the mountain shape is the butting portion 47. The butting portion 47 extends in the radial direction of the first paying out rotor 23.

Figure 11:
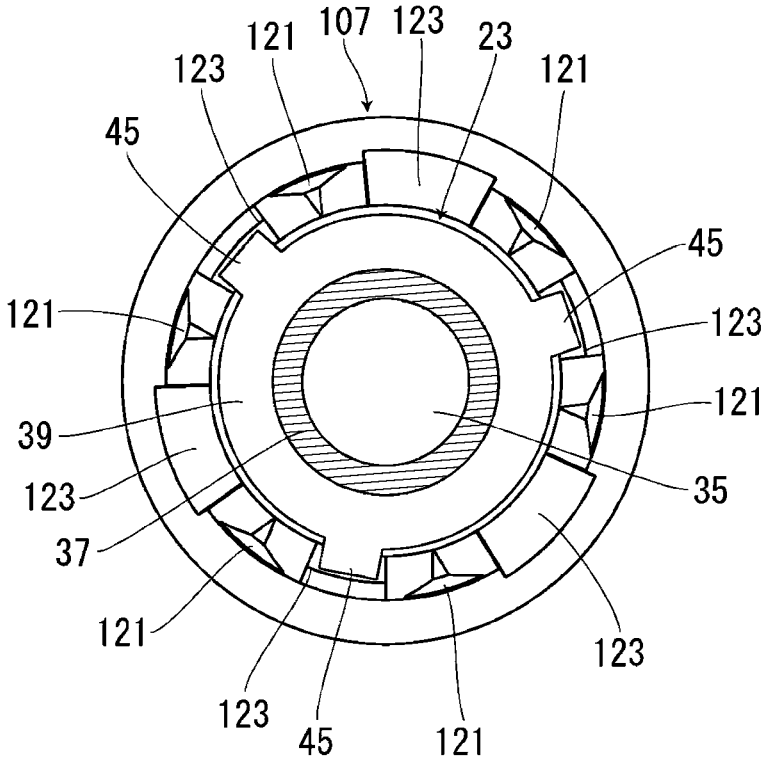
FIG. 11 is a cross-sectional view of the first paying out rotor inserted into the first paying out core.
Figure 11:
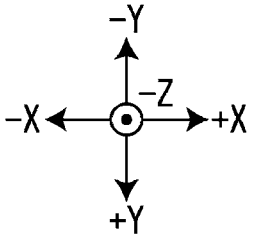

When tape cartridge 101 is mounted in the cartridge mounting section 3, as shown in FIG. 11, the three rotor side engaging portions 45 are inserted between the six core side engaging portions 121. Specifically, each of the three rotor side engaging portions 45 is inserted into every other core side insertion recessed portion 123 of the six core side insertion recessed portions 123. Thereby, when the first paying out rotor 23 rotates, the rotor side engaging portion 45 engages with the core side engaging portion 121 and the rotation of the first paying out rotor 23 is transmitted to the first paying out core 107.

When the tape cartridge 101 is being mounted in the cartridge mounting section 3, if the tape cartridge 101 advances in the mounting direction in a state in which the core side insertion recessed portion 123 faces the butting portion 47, the core side engaging portion 121 does not hit the butting portion 47 and the rotor side engaging portion 45 is inserted between the core side engaging portions 121.

On the other hand, when the tape cartridge 101 is being mounted in the cartridge mounting section 3, if the tape cartridge 101 advances in the mounting direction in a state in which the core side engaging portion 121 faces the butting portion 47, the first engaging inclined surface 127 or the second engaging inclined surface 129 of the core side engaging portion 121 butts against the butting portion 47. When the first engaging inclined surface 127 butts against the butting portion 47, the first paying out rotor 23 rotates counterclockwise as viewed from the mounting direction, so that the rotor side engaging portion 45 is inserted between the core side engaging portions 121. When the second engaging inclined surface 129 butts against the butting portion 47, the first paying out rotor 23 rotates clockwise as viewed from the mounting direction, so that the rotor side engaging portion 45 is inserted between the core side engaging portions 121.

Figure 9:
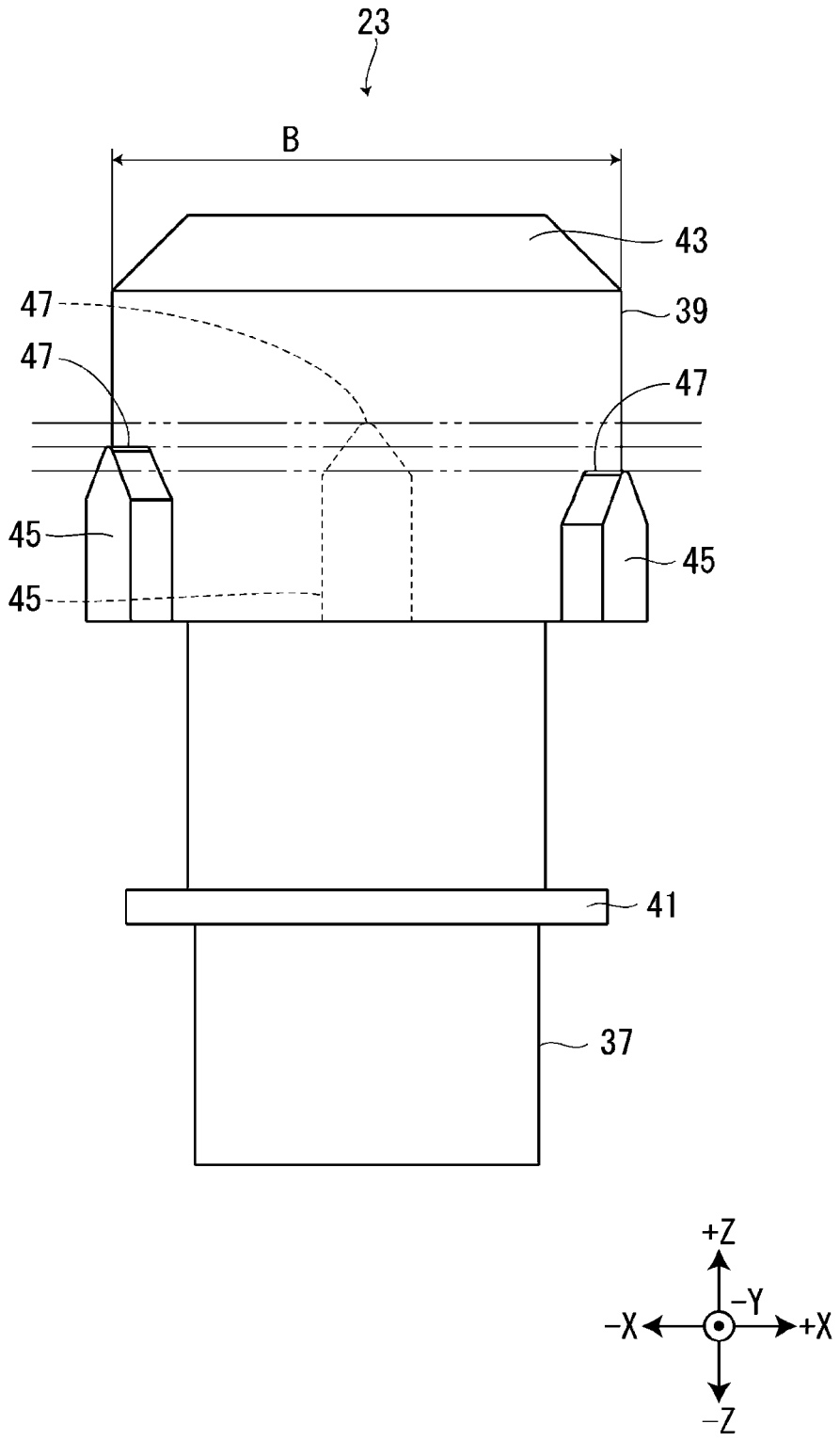
FIG. 9 is a diagram of the first paying out rotor viewed from the −Y side.
Figure 10:
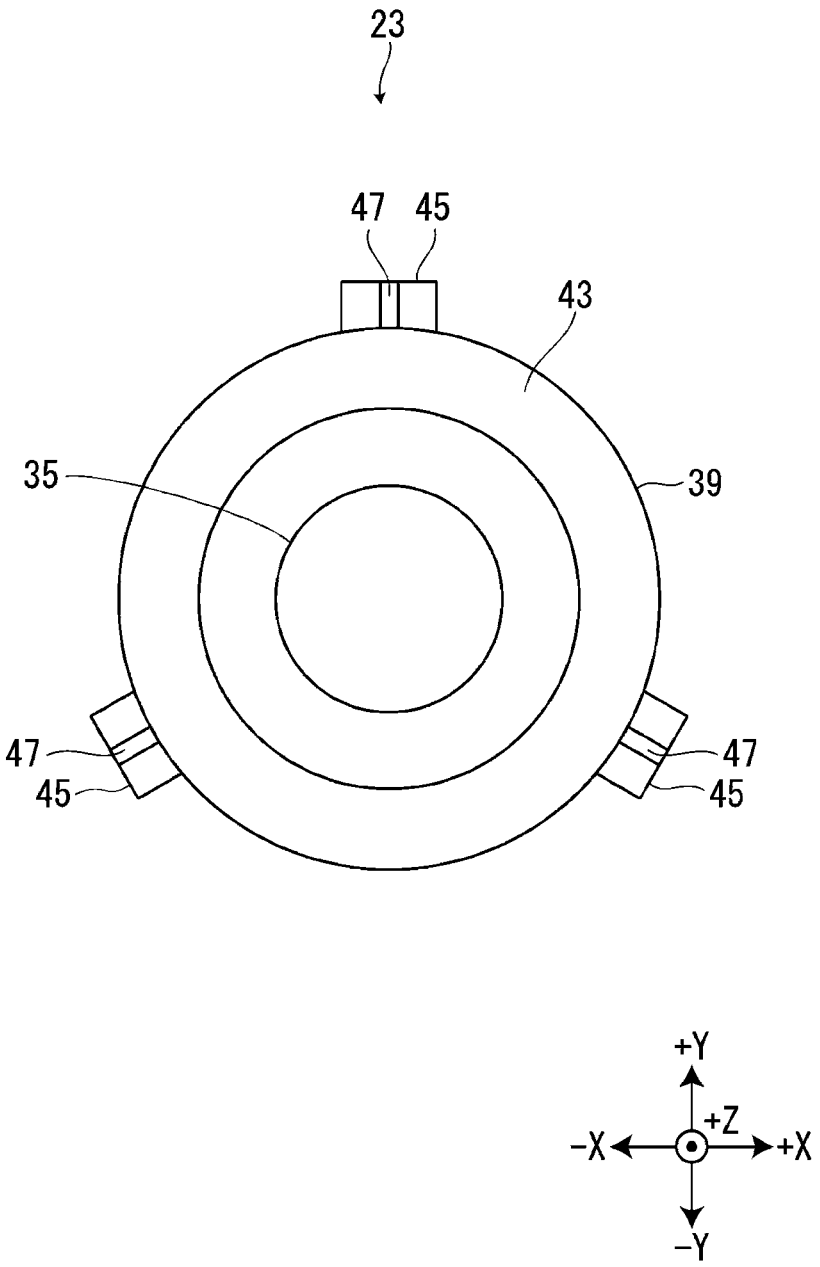
FIG. 10 is a diagram of the first paying out rotor viewed from the +Z side.

Here, as shown in FIG. 9, the three butting portions 47 are provided in positions different from each other in the mounting direction. Three two-dot chain lines shown in FIG. 9 show the differences of positions in the mounting direction of the three butting portions 47. Surfaces in the mounting direction of the three rotor side engaging portions 45 and a surface in the mounting direction of the large diameter portion 39 are formed substantially flush with each other. In other words, the lengths in the mounting direction of the three rotor side engaging portions 45 are different from each other.

Here, different from the present embodiment, in a configuration in which the three butting portions 47 are provided in the same position in the mounting direction, when the tape cartridge 101 is being mounted in the cartridge mounting section 3, there is a case in which at substantially the same time when the first engaging inclined surface 127 of one core side engaging portion 121 butts against one butting portion 47, the second engaging inclined surface 129 of another core side engaging portion 121 butts against another butting portion 47. In this case, a force that rotates the first paying out rotor 23 counterclockwise as viewed from the mounting direction and a force that rotates the first paying out rotor 23 clockwise as viewed from the mounting direction become even, so that the first paying out rotor 23 cannot rotate in either direction. Therefore, the rotor side engaging portion 45 hits against the core side engaging portion 121, so that a user cannot smoothly mount the tape cartridge 101 in the cartridge mounting section 3.

Figure 12:
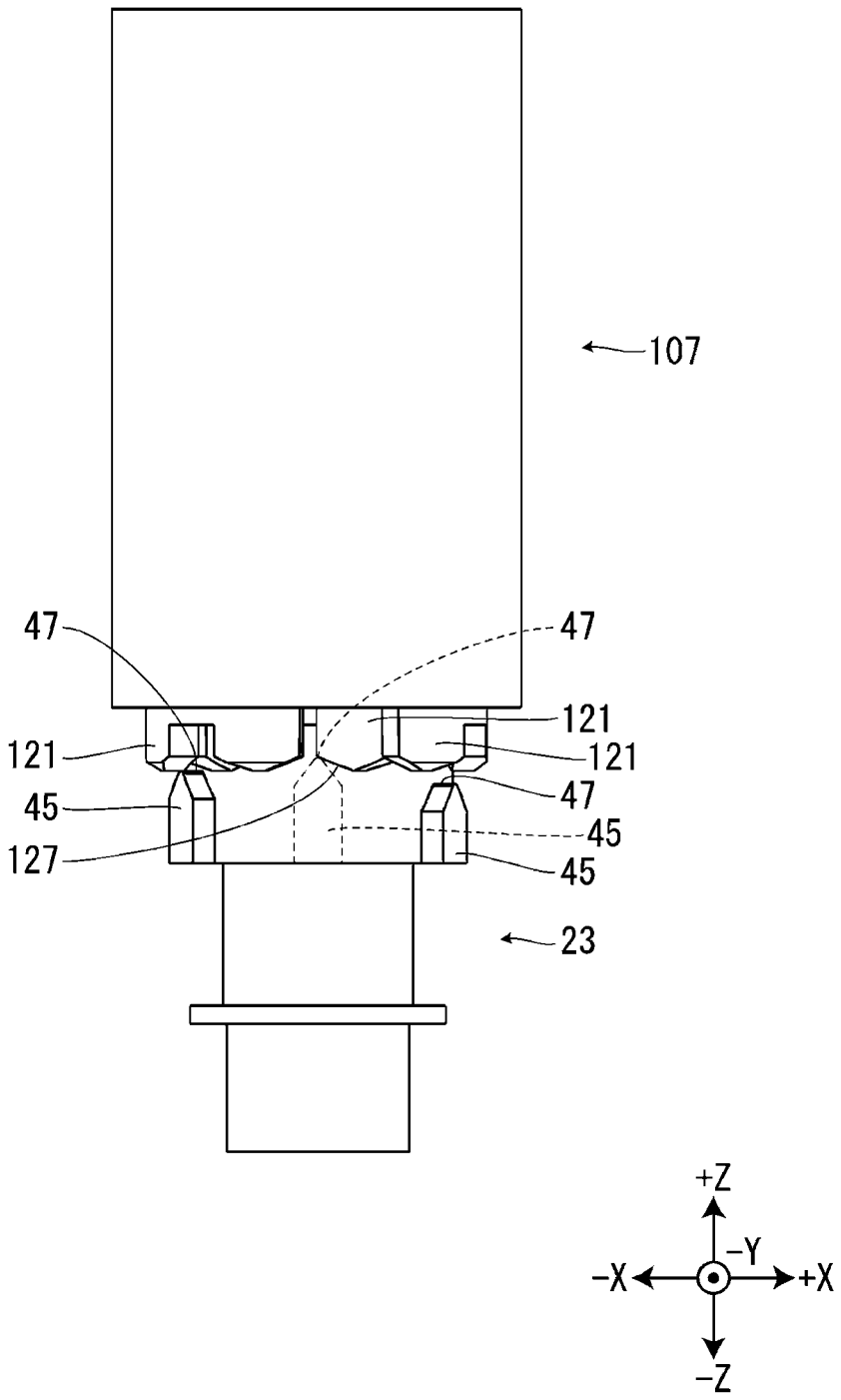
FIG. 12 is a diagram of the first paying out rotor, which is being inserted into the first paying out core, viewed from the −Y side.

On the other hand, in the present embodiment, as described above, the three butting portions 47 are provided in positions different from each other in the mounting direction. For example, as shown in FIG. 12, when the first engaging inclined surface 127 of one core side engaging portion 121 butts against the butting portion 47 of the rotor side engaging portion 45 indicated by a dashed line, that is, the butting portion 47 located farthest in the opposite direction of the mounting direction, none of the first engaging inclined surfaces 127 and the second engaging inclined surfaces 129 of the other two core side engaging portions 121 butts against the other two butting portions 47. In this way, it is restrained that at substantially the same time when the first engaging inclined surface 127 of one core side engaging portion 121 butts against one butting portion 47, the second engaging inclined surface 129 of another core side engaging portion 121 butts against another butting portion 47.

When the first engaging inclined surface 127 or the second engaging inclined surface 129 of one core side engaging portion 121 butts against one butting portion 47, the first paying out rotor 23 can rotate counterclockwise or clockwise as viewed from the mounting direction, so that the rotor side engaging portion 45 is inserted between the core side engaging portions 121 without causing the rotor side engaging portion 45 to hit against the core side engaging portion 121. When the tape cartridge 101 is being mounted in the cartridge mounting section 3, the core side engaging portion 121 may butt against only one of the three butting portions 47, or the three core side engaging portions 121 may butt against the three butting portions 47, respectively and sequentially.

As described above, according to the tape printing apparatus 1 of the first embodiment, the three paying out portions 47 provided to the first paying out rotor 23 are provided in positions different from each other in the mounting direction. Thereby, when the tape cartridge 101 is being mounted in the cartridge mounting section 3, it is restrained that at substantially the same time when the first engaging inclined surface 127 of one core side engaging portion 121 butts against one butting portion 47, the second engaging inclined surface 129 of another core side engaging portion 121 butts against another butting portion 47. Therefore, when one core side engaging portion 121 butts against one butting portion 47, the first paying out rotor 23 can rotate, so that the rotor side engaging portion 45 is inserted between the core side engaging portions 121 without causing the rotor side engaging portion 45 to hit against the core side engaging portion 121. Therefore, a user can smoothly mount the tape cartridge 101 in the cartridge mounting section 3. The above description can also be applied to a case in which the ribbon cartridge 201 is being mounted in the cartridge mounting section 3.

Second Embodiment

Subsequently, the tape printing apparatus 1, the tape cartridge 101, and the ribbon cartridge 201 of the second embodiment will be described. The tape printing apparatus 1, the tape cartridge 101, and the ribbon cartridge 201 of the second embodiment are configured in substantially the same manner as the tape printing apparatus 1, the tape cartridge 101, and the ribbon cartridge 201 of the first embodiment, so that different points will be mainly described.

The tape cartridge 101 of the second embodiment includes a different type of first paying out core 107 according to the widths of the first print tape 113 and the first ink ribbon 117 that are stored. Specifically, the tape cartridge 101 that stores a narrow first print tape 113 and a narrow first ink ribbon 117 includes the first paying out core 107 described above. On the other hand, the tape cartridge 101 that stores a wide first print tape 113 and a wide first ink ribbon 117 includes a first paying out core 107*a* that is a modified example of the first paying out core 107.

Similarly, the ribbon cartridge 201 of the second embodiment includes a different type of second paying out core 207 according to the width of the stored second ink ribbon 217. Specifically, the ribbon cartridge 201 that stores a narrow second ink ribbon 217 includes the second paying out core 207 described above. On the other hand, the ribbon cartridge 201 that stores a wide second ink ribbon 217 includes a second paying out core 207*a* that is a modified example of the second paying out core 207. The first paying out core 107*a* and the second paying out core 207*a* are configured in the same manner, so that the first paying out core 107*a* will be representatively described.

Figure 13:
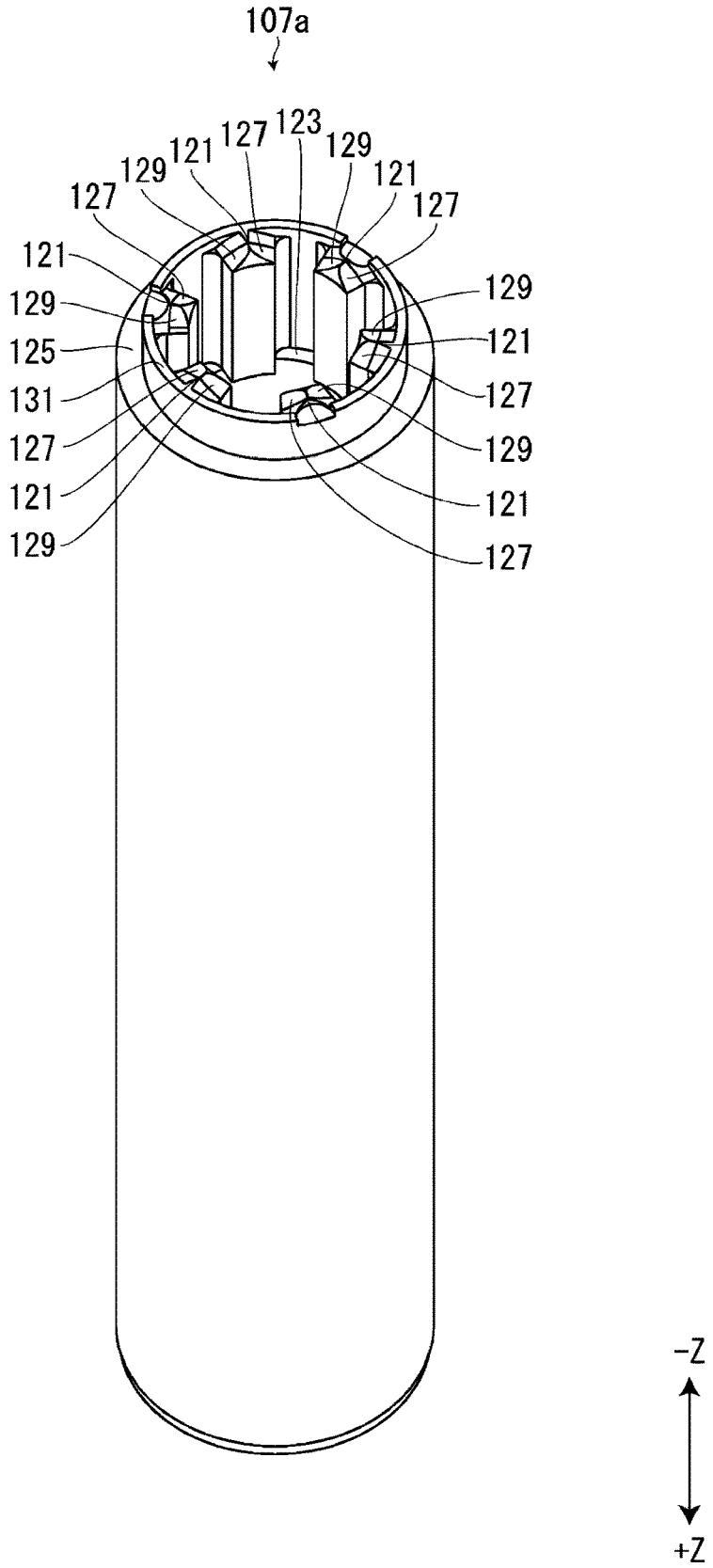
FIG. 13 is a perspective view of a first paying out core according to a modified example.
Figure 14:
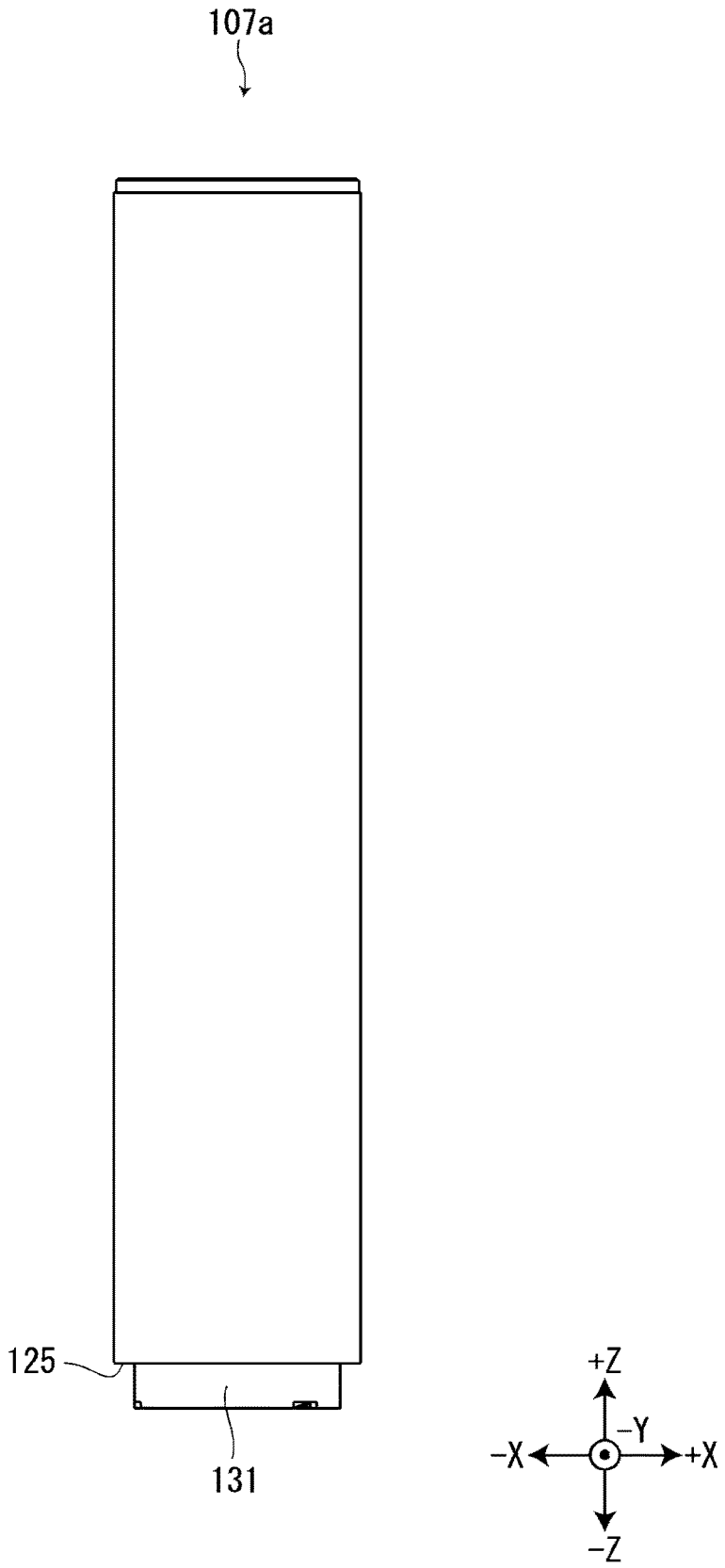
FIG. 14 is a diagram of the first paying out core according to the modified example viewed from the −Y side.
Figure 15:
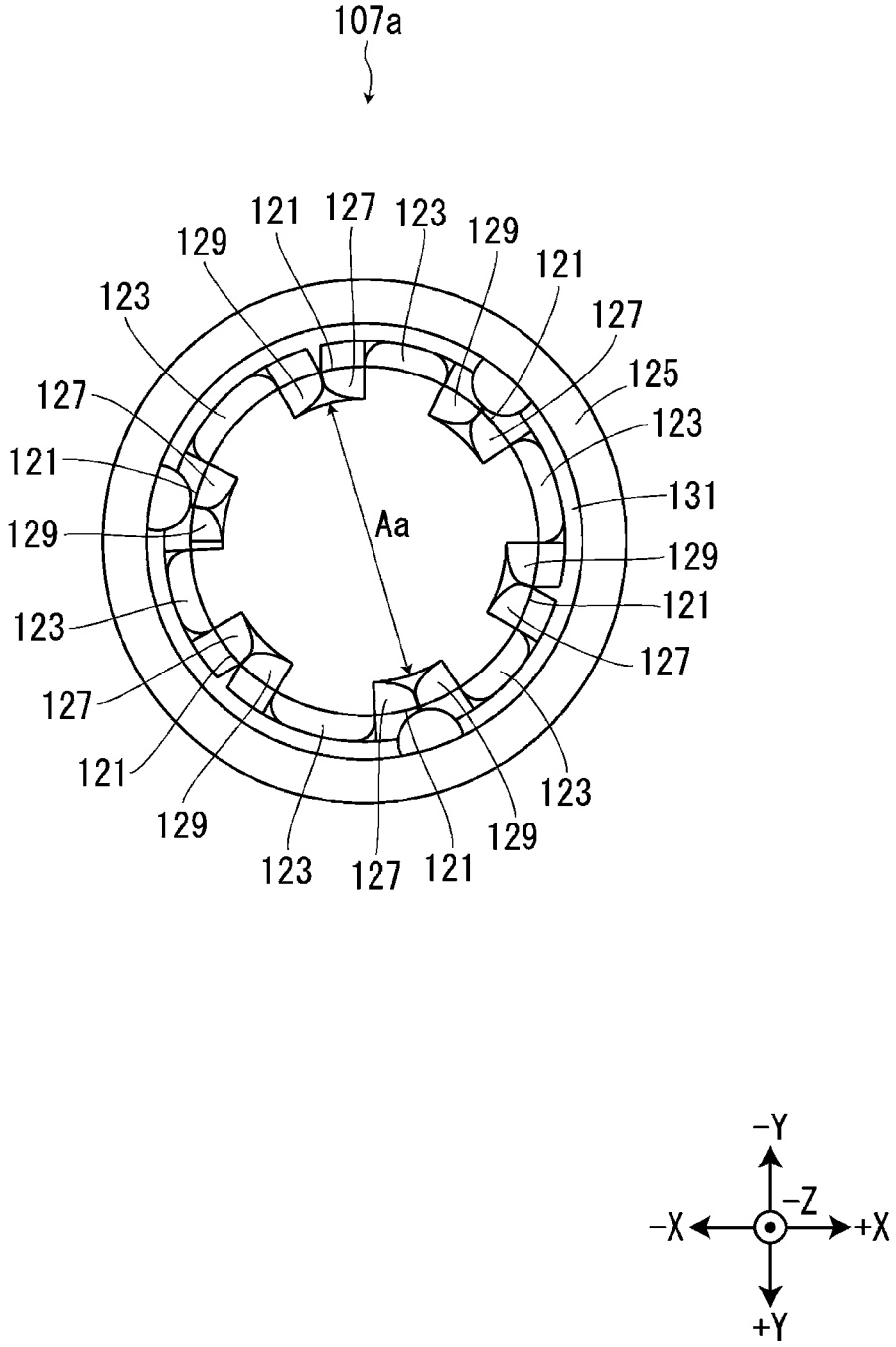
FIG. 15 is a diagram of the first paying out core according to the modified example viewed from the −Z side.

As shown in FIGS. 13 to 15, the first paying out core 107*a* includes a ring portion 131 surrounding the six core side engaging portions 121. Specifically, in the first paying out core 107*a*, the six core side engaging portions 121 are provided so as to protrude from an inner circumferential surface of the ring portion 131. The core side engaging portion 121 of the first paying out core 107*a* is formed thicker than the core side engaging portion 121 of the first paying out core 107. Therefore, a diameter Aa (see FIG. 15) of a space surrounded by the six core side engaging portions 121 of the first paying out core 107*a* is smaller than a diameter A (see FIG. 7) of a space surrounded by the six core side engaging portions 121 of the first paying out core 107. The thickness of the core side engaging portion 121 means a dimension in the radial direction of the first paying out core 107 or the first paying out core 107*a*. In this way, the first paying out core 107*a* includes the ring portion 131 and the core side engaging portion 121 is formed thick, so that shock resistance strength of the first paying out core 107*a* is improved and the core side engaging portion 121 is restrained from being damaged when the tape cartridge 101 falls or the like.

The tape printing apparatus 1 of the second embodiment includes a first paying out rotor 23*a* that is a modified example of the first paying out rotor 23 described above and a second paying out rotor 27*a* that is a modified example of the second paying out rotor 27 described above. The first paying out rotor 23*a* and the second paying out rotor 27*a* are configured in the same manner, so that the first paying out rotor 23*a* will be representatively described.

Figure 16:
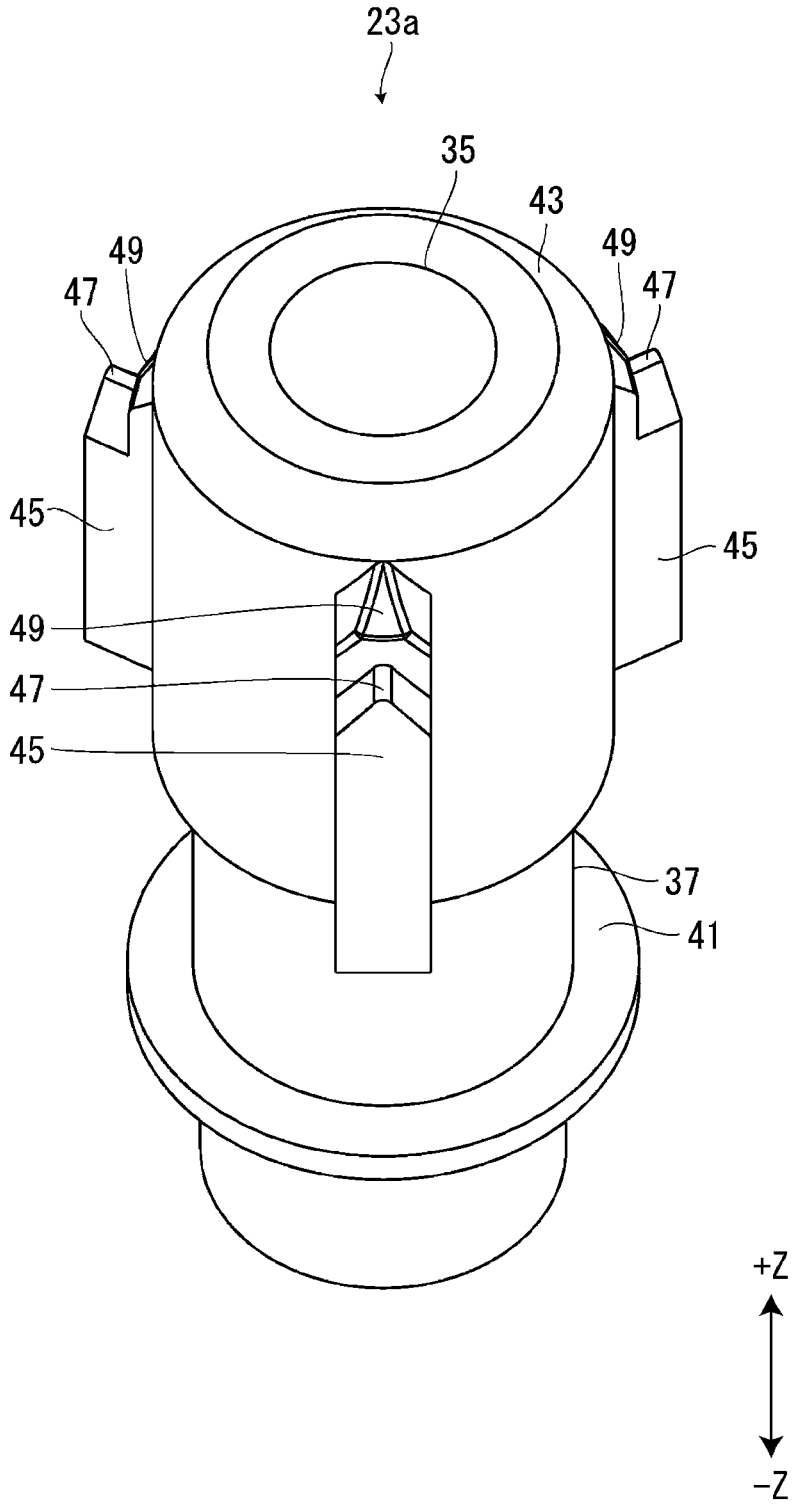
FIG. 16 is a perspective view of a first paying out rotor according to the modified example.
Figure 17:
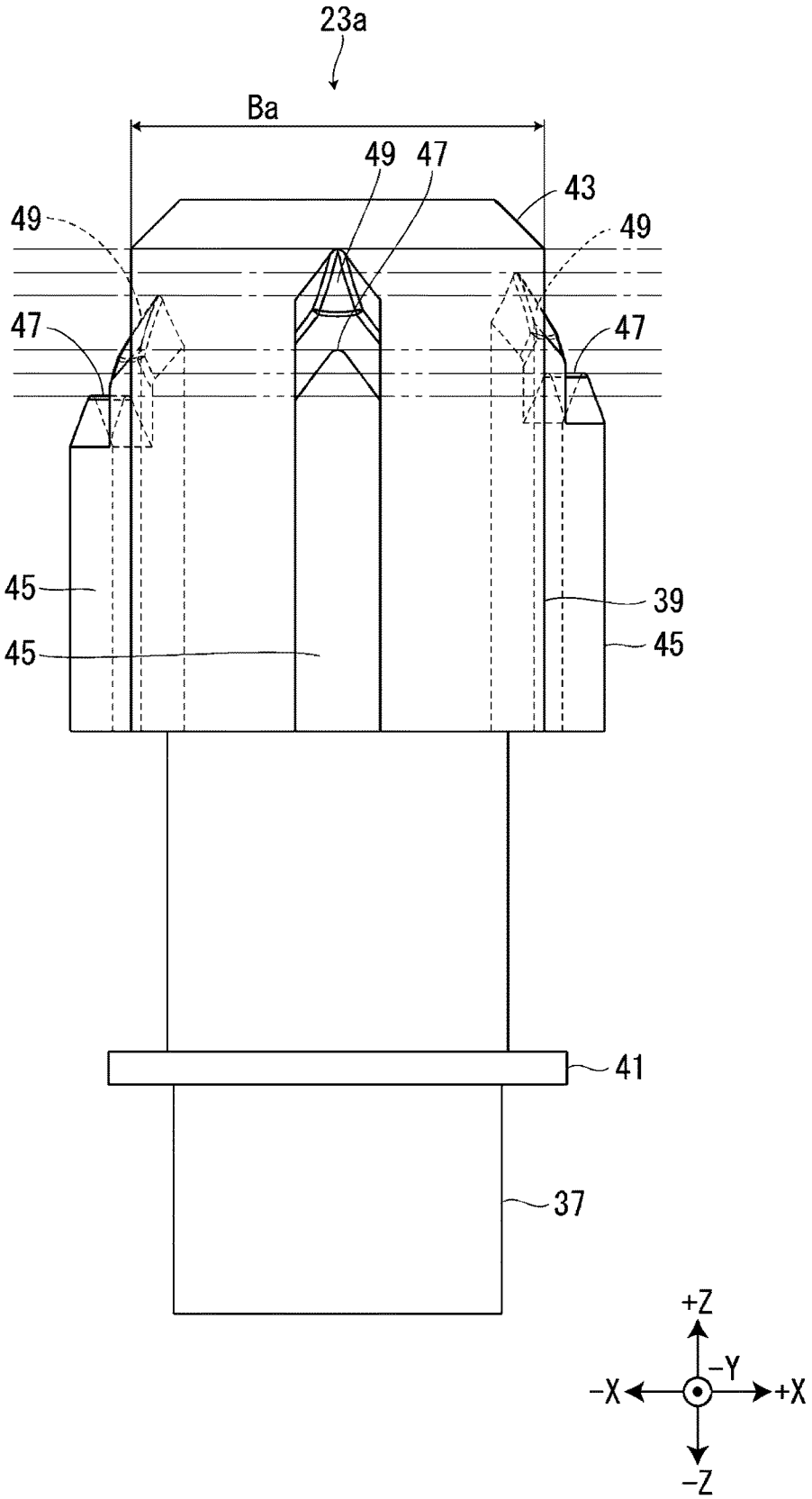
FIG. 17 is a diagram of the first paying out rotor according to the modified example viewed from the −Y side.
Figure 18:
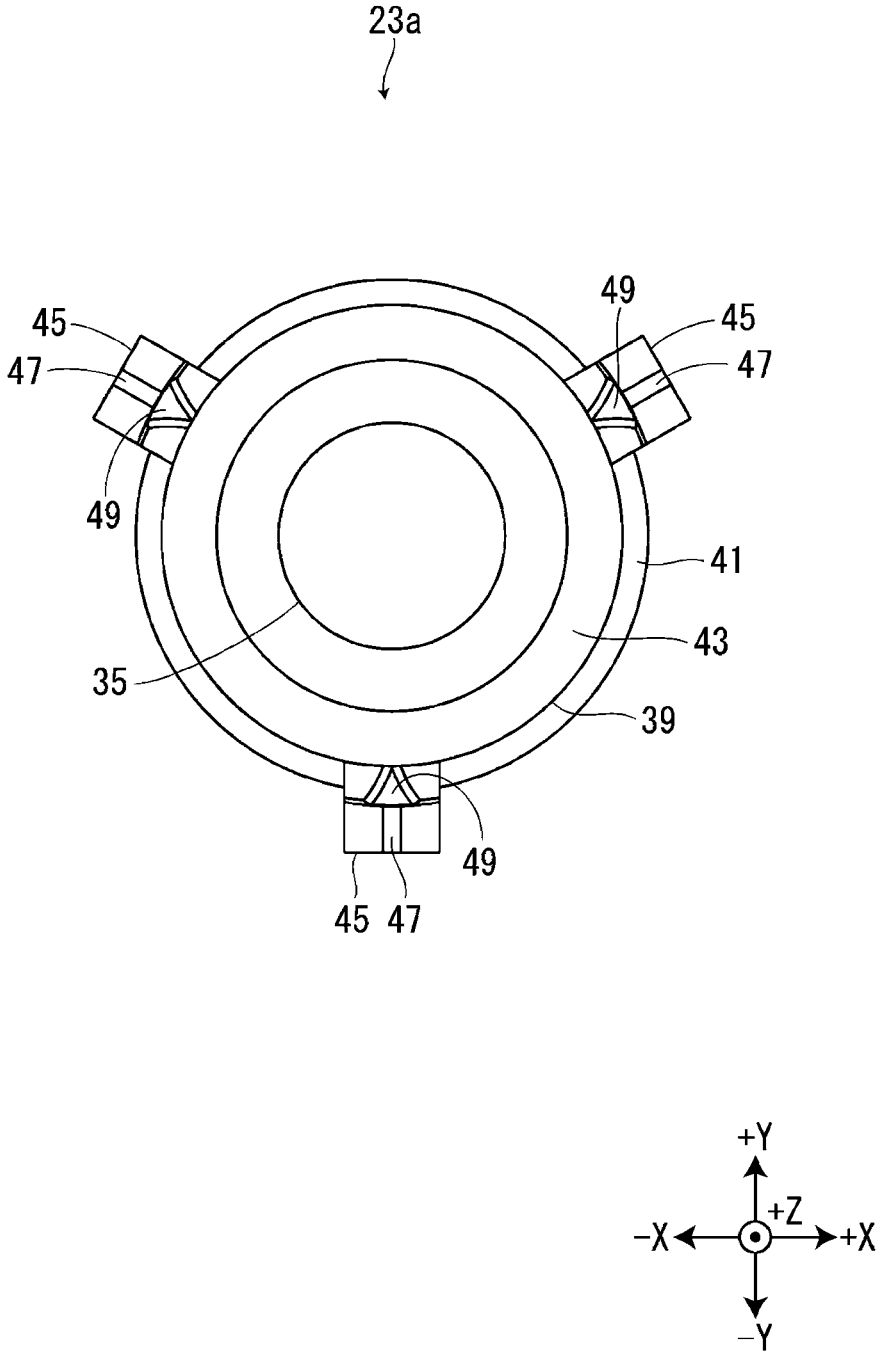
FIG. 18 is a diagram of the first paying out rotor according to the modified example viewed from the +Z side.

As shown in FIGS. 16 to 18, the rotor side engaging portion 45 of the first paying out rotor 23*a* includes a guide inclined surface 49. The guide inclined surface 49 is provided more inside than the butting portion 47 in the radial direction of the first paying out rotor 23*a* and at a position higher than the butting portion 47 in the opposite direction of the mounting direction. The guide inclined surface 49 is formed into a substantially isosceles triangle shape and is formed into an inclined surface more inclining to the mounting direction as tending to the outside in the radial direction of the first paying out rotor 23*a*.

As described above, the diameter Aa of the space surrounded by the six core side engaging portions 121 of the first paying out core 107*a* is smaller than the diameter A of the space surrounded by the six core side engaging portions 121 of the first paying out core 107, so that accordingly, a diameter Ba (see FIG. 17) of the large diameter portion 39 of the first paying out rotor 23*a* is smaller than a diameter B (see FIG. 9) of the large diameter portion 39 of the first paying out rotor 23.

Also in the first paying out rotor 23*a*, in the same manner as the first paying out rotor 23, the three butting portions 47 are provided in positions different from each other in the mounting direction. Three two-dot chain lines shown in FIG. 17 show the differences of positions in the mounting direction of the three butting portions 47. Thereby, it is restrained that at substantially the same time when the first engaging inclined surface 127 of one core side engaging portion 121 butts against one butting portion 47, the second engaging inclined surface 129 of another core side engaging portion 121 butts against another butting portion 47.

Figure 19:
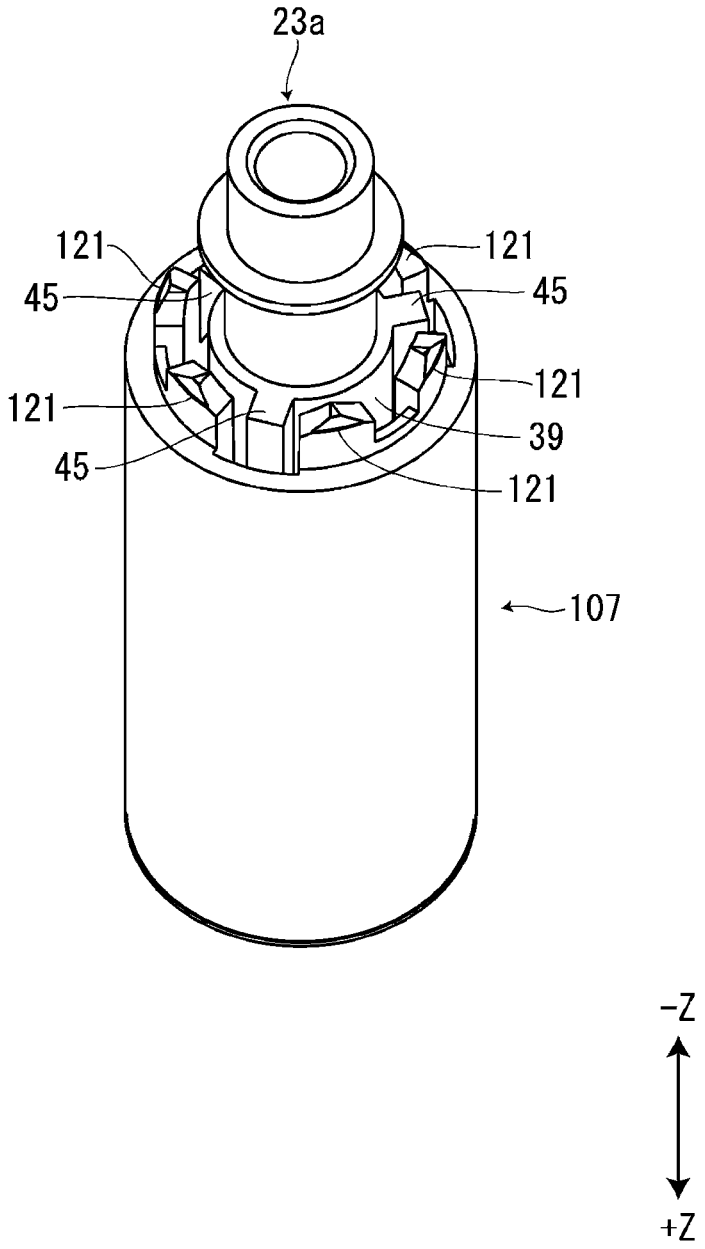
FIG. 19 is a perspective view of the first paying out rotor according to the modified example inserted into the first paying out core.
Figure 20:
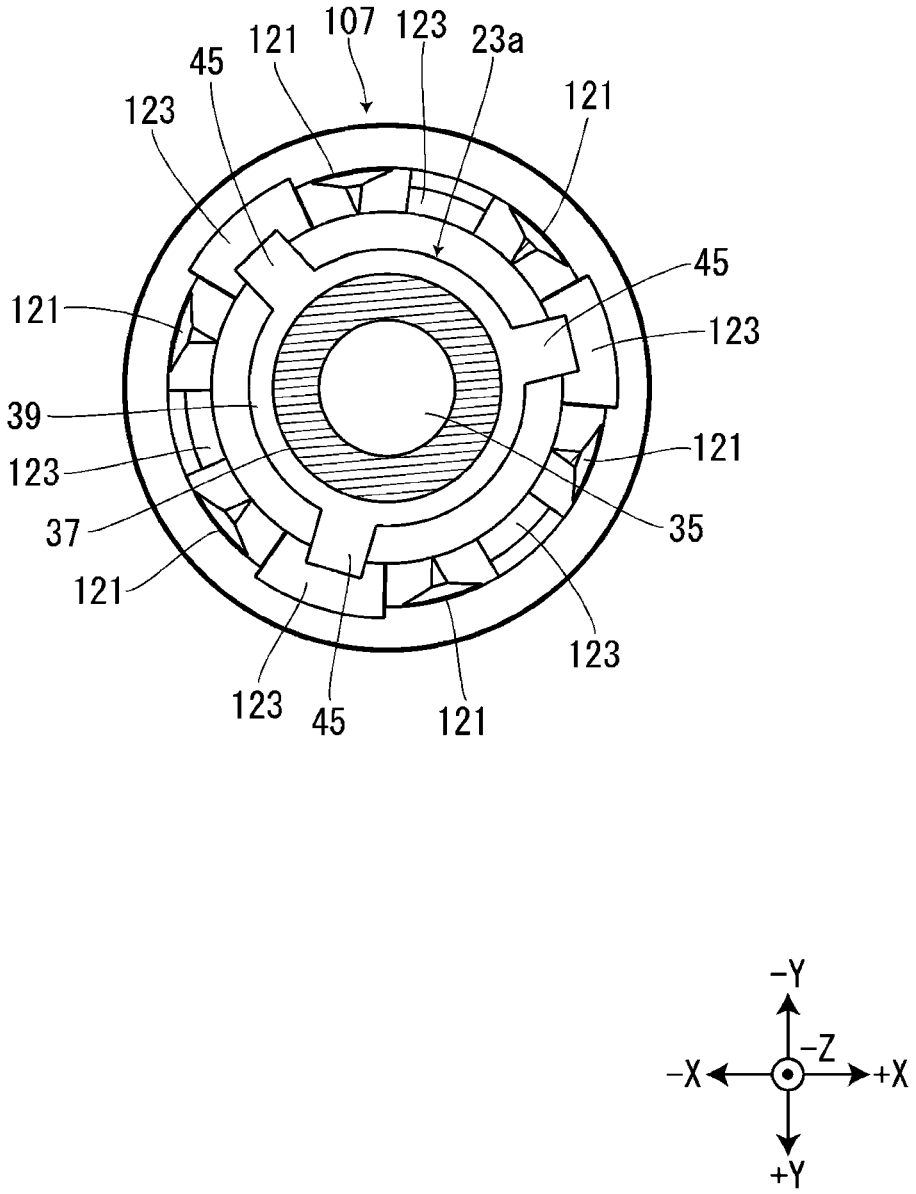
FIG. 20 is a cross-sectional view of the first paying out rotor according to the modified example inserted into the first paying out core.
Figure 21:
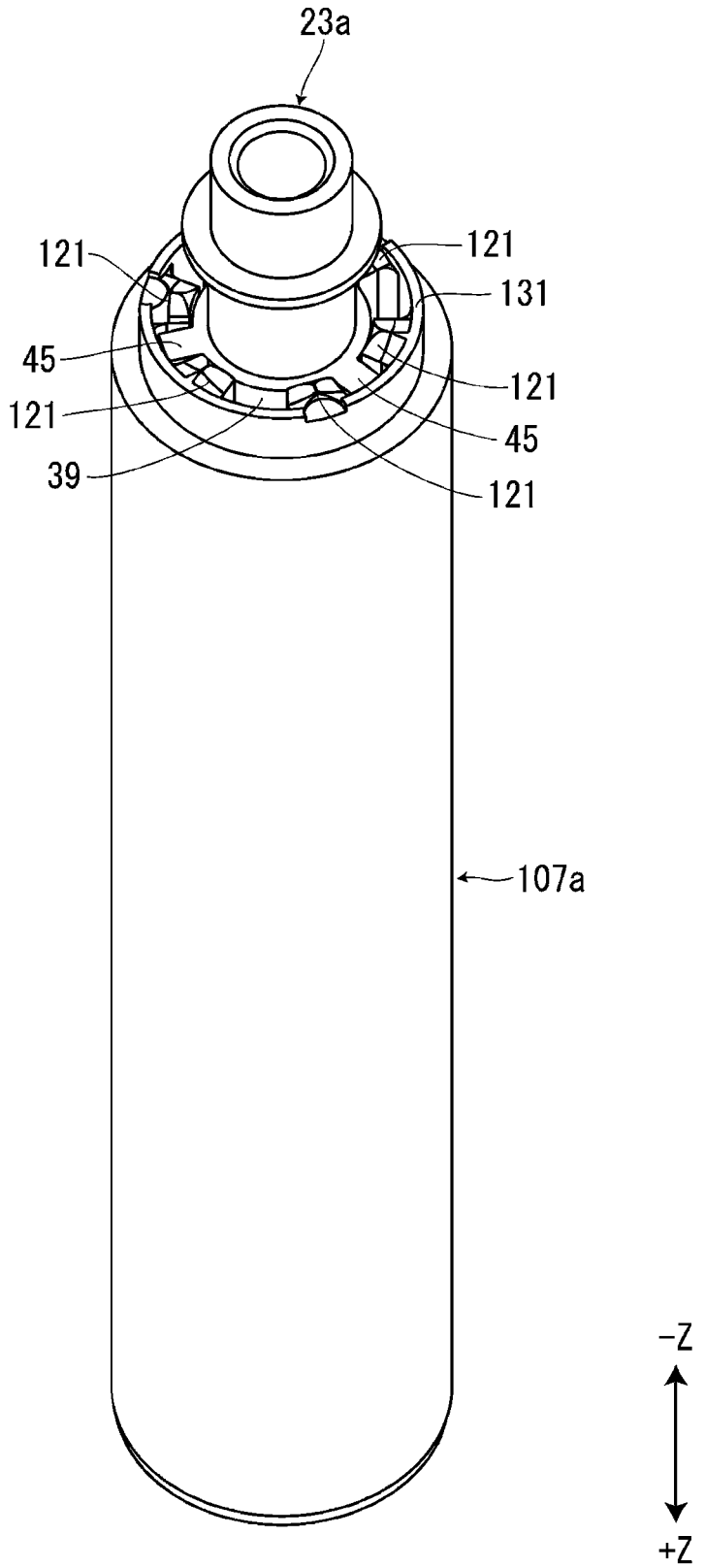
FIG. 21 is a perspective view of the first paying out rotor according to the modified example inserted into the first paying out core according to the modified example.
Figure 22:
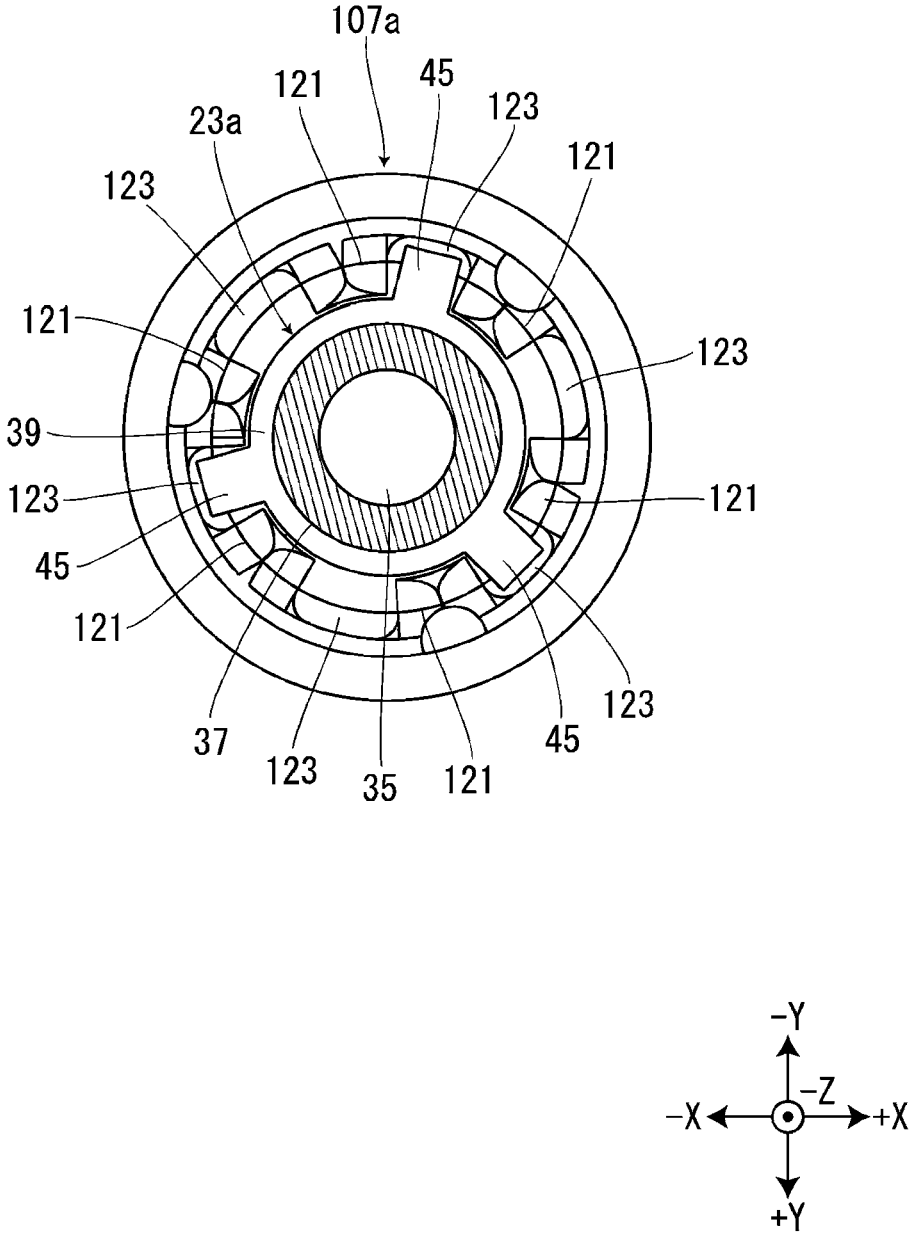
FIG. 22 is a cross-sectional view of the first paying out rotor according to the modified example inserted into the first paying out core according to the modified example.

When the tape cartridge 101 including the first paying out core 107 is mounted in the cartridge mounting section 3 provided with the first paying out rotor 23*a*, as shown in FIGS. 19 and 20, the large diameter portion 39 of the first paying out rotor 23*a* is inserted into the first paying out core 107 and the three rotor side engaging portions 45 are inserted between the six core side engaging portions 121. When the tape cartridge 101 including the first paying out core 107*a* is mounted in the cartridge mounting section 3 provided with the first paying out rotor 23*a*, as shown in FIGS. 21 and 22, the large diameter portion 39 of the first paying out rotor 23*a* is inserted into the first paying out core 107*a* and the three rotor side engaging portions 45 are inserted between the six core side engaging portions 121. In this way, any of the tape cartridge 101 including the first paying out core 107 and the tape cartridge 101 including the first paying out core 107*a* can be mounted in the cartridge mounting section 3 provided with the first paying out rotor 23*a*.

Figure 23:
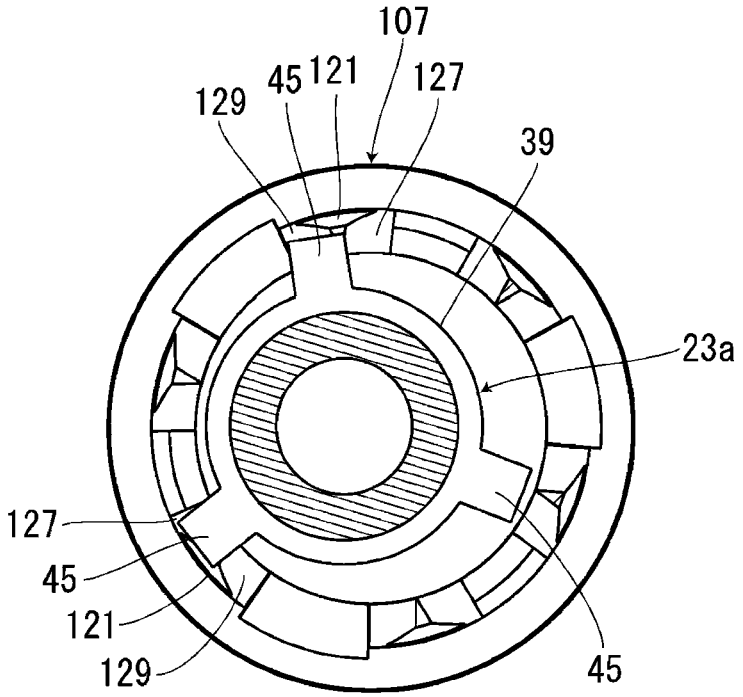
FIG. 23 is a cross-sectional view of the first paying out rotor according to the modified example, which is inserted into the first paying out core in a state where the center of the first paying out rotor is deviated.
Figure 23:
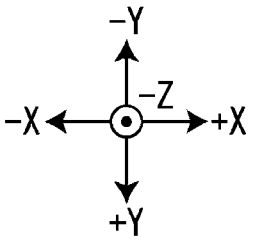

Here, as described above, when the tape cartridge 101 including the first paying out core 107 where the diameter of the space surrounded by the six core side engaging portions 121 is relatively large is mounted in the cartridge mounting section 3 provided with the first paying out rotor 23*a* where the diameter of the large diameter portion 39 is relatively small, a relatively large gap is generated between the outer circumferential surface of the large diameter portion 39 and an inner circumferential surface of the six core side engaging portions 121 (see FIG. 20). Therefore, the center of the first paying out core 107 tends to deviate from the center of the large diameter portion 39 of the first paying out rotor 23*a*. As shown in FIG. 23, if the core side engaging portion 121 butts against the butting portion 47 of the rotor side engaging portion 45 in a state in which the center of the first paying out core 107 deviates from the center of the large diameter portion 39 of the first paying out rotor 23*a*, there is a risk that at substantially the same time when the first engaging inclined surface 127 of one core side engaging portion 121 butts against one butting portion 47, the second engaging inclined surface 129 of another core side engaging portion 121 butts against another butting portion 47. In this case, as described above, the first paying out rotor 23*a* cannot rotate counterclockwise or clockwise as viewed from the mounting direction, so that the rotor side engaging portion 45 is not inserted between the core side engaging portions 121.

On the other hand, in the present embodiment, the guide inclined surface 49 is provided to the rotor side engaging portion 45 of the first paying out rotor 23*a*, so that if the center of the first paying out core 107 deviates from the center of the large diameter portion 39 of the first paying out rotor 23*a*, the core side engaging portion 121 butts against the guide inclined surface 49. The guide inclined surface 49 guides the core side engaging portion 121 butting against the guide inclined surface 49 to the outside in the radial direction of the first paying out rotor 23*a*. Thereby, the first paying out core 107 moves in the radial direction so that the center of the first paying out core 107 coincides with the center of the large diameter portion 39 of the first paying out rotor 23*a* and the position of the paying out core 107 is corrected. The first paying out core 107 can move in the radial direction of the first paying out core 107 by a distance corresponding to a gap between the first paying out core 107 and the first cartridge case 111.

As shown in FIG. 17, the three guide inclined surfaces 49 are provided in positions different from each other in the mounting direction. Three chain lines shown in FIG. 17 show the differences of positions in the mounting direction of the three guide inclined surfaces 49. The guide inclined surface 49 provided farthest in the opposite direction of the mounting direction among the three guide inclined surfaces 49 continues to the chamfered portion 43 provided on the large diameter portion 39. Therefore, when the tape cartridge 101 is being mounted in the cartridge mounting section 3, the core side engaging portion 121 butting against the chamfered portion 43 is smoothly introduced onto the guide inclined surface 49. The guide inclined surface 49 provided farthest in the mounting direction is provided farther in the opposite direction of the mounting direction than the butting portion 47 provided nearest in the mounting direction.

Here, different from the present embodiment, in a configuration in which the three guide inclined surfaces 49 are provided in the same position in the mounting direction, when the tape cartridge 101 is being mounted in the cartridge mounting section 3, there is a case in which at substantially the same time when one core side engaging portion 121 butts against one guide inclined surface 49, another core side engaging portion 121 butts against another guide inclined surface 49. In this case, a force by which the one core side engaging portion 121 butting against the one guide inclined surface 49 is guided and a force by which the other core side engaging portion 121 butting against the other guide inclined surface 49 is guided become even, so that there is a risk that the first paying out core 107 cannot move in either direction.

On the other hand, in the present embodiment, as described above, the three guide inclined surfaces 49 are provided in positions different from each other in the mounting direction. Thereby, it is restrained that at substantially the same time when one core side engaging portion 121 butts against one guide inclined surface 49, another core side engaging portion 121 butts against another guide inclined surface 49. Then, one core side engaging portion 121 butts against one guide inclined surface 49, and thereby the first paying out core 107 moves so that the center of the first paying out core 107 coincides with the center of the large diameter portion 39 of the first paying out rotor 23*a*. Therefore, it can be restrained that the core side engaging portion 121 butts against the butting portion 47 of the rotor side engaging portion 45 in a state in which the center of the first paying out core 107 deviates from the center of the large diameter portion 39 of the first paying out rotor 23*a*. When the tape cartridge 101 is being mounted in the cartridge mounting section 3, one core side engaging portion 121 may butt against one guide inclined surface 49 while the other two core side engaging portions 121 do not butt against the other two guide inclined surfaces 49, or the three core side engaging portions 121 may sequentially butt against the three guide inclined surfaces 49.

As described above, according to the tape printing apparatus 1 of the second embodiment, in the same manner as the tape printing apparatus 1 of the first embodiment, the three butting portions 47 provided to the first paying out rotor 23*a* are provided in positions different from each other in the mounting direction. Thereby, when the tape cartridge 101 is being mounted in the cartridge mounting section 3, it is restrained that at substantially the same time when the first engaging inclined surface 127 of one core side engaging portion 121 butts against one butting portion 47, the second engaging inclined surface 129 of another core side engaging portion 121 butts against another butting portion 47. Therefore, when one core side engaging portion 121 butts against one butting portion 47, the first paying out rotor 23*a* can rotate, so that the rotor side engaging portion 45 is inserted between the core side engaging portions 121 without causing the rotor side engaging portion 45 to hit against the core side engaging portion 121. Therefore, a user can smoothly mount the tape cartridge 101 in the cartridge mounting section 3. The above description can also be applied to a case in which the ribbon cartridge 201 is being mounted in the cartridge mounting section 3.

According to the tape printing apparatus 1 of the second embodiment, the guide inclined surface 49 is provided to the first paying out rotor 23*a*. Thereby, when the tape cartridge 101 including the first paying out core 107 is being mounted in the cartridge mounting section 3, it is restrained that the core side engaging portion 121 butts against the butting portion 47 of the rotor side engaging portion 45 in a state in which the center of the first paying out core 107 deviates from the center of the large diameter portion 39 of the first paying out rotor 23*a*. Therefore, it can be restrained that at substantially the same time when the first engaging inclined surface 127 of one core side engaging portion 121 butts against one butting portion 47, the second engaging inclined surface 129 of another core side engaging portion 121 butts against another butting portion 47. The above description can also be applied to a case in which the tape cartridge 101 including the first paying out core 107*a* is being mounted in the cartridge mounting section 3. Further, the above description can also be applied to a case in which the ribbon cartridge 201 is being mounted in the cartridge mounting section 3.

Other Modified Examples

It is needless to say that the present disclosure is not limited to the embodiments described above, and various configurations can be employed without departing from the scope of the disclosure. For example, the embodiments described above can be modified to forms as described below.

The present disclosure is not limited to a configuration in which when the core side engaging portion 121 butts against the butting portion 47, the first paying out rotor 23 rotates, so that the rotor side engaging portion 45 is inserted between the core side engaging portions 121. One of the first paying out rotor 23 and the first paying out core 107 may rotate with respect to the other. For example, the first paying out core 107 may rotate, or the first paying out rotor 23 and the first paying out core 107 may rotate in directions opposite to each other.

The surfaces in the mounting direction of the three rotor side engaging portions 45 and the surface in the mounting direction of the large diameter portion 39 are formed substantially flush with each other, and the lengths in the mounting direction of the three rotor side engaging portions 45 are different from each other. However, the present disclosure is not limited to the above conditions. That is, when the three butting portions 47 are provided in positions different from each other in the mounting direction, the surfaces deep in the mounting direction of the three rotor side engaging portions 45 and the surface in the mounting direction of the large diameter portion 39 need not be formed substantially flush with each other. When the three butting portions 47 are provided in positions different from each other in the mounting direction, the three rotor side engaging portions 45 may have the same length.

The tape printing apparatus 1 is not limited to a configuration including both the first paying out rotor 23 and the second paying out rotor 27, but may have a configuration including either one of the first paying out rotor 23 and the second paying out rotor 27. Specifically, the cartridge mounting section 3 is not limited to a configuration where the tape cartridge 101 and the ribbon cartridge 201 can be alternatively mounted, but may have a configuration where either the tape cartridge 101 or the ribbon cartridge 201 can be mounted.

It is possible to employ a configuration in which the embodiments and the modified examples described above are combined.

APPENDIX

Hereinafter, an appendix for the ink ribbon feeding mechanism and the tape printing apparatus will be described.

The ink ribbon feeding mechanism includes a cartridge mounting section where a cartridge including a paying out core around which an ink ribbon is wound and in which a plurality of core side engaging portions and a plurality of core side insertion recessed portions are alternately provided in a circumferential direction is mounted, a paying out shaft provided in the cartridge mounting section, a paying out rotor which is rotatably provided to the paying out shaft and is inserted into the paying out core when the cartridge is being mounted in the cartridge mounting section, and a plurality of rotor side engaging portions which are provided on an outer circumferential surface of the paying out rotor so as to protrude in a radial direction and which engage with the plurality of core side engaging portions when the paying out rotor rotates. The plurality of rotor side engaging portions have an butting portion provided near in a mounting direction of the cartridge, and when the cartridge is being mounted in the cartridge mounting section, if the core side engaging portion provided in the mounting direction of the cartridge butts against the butting portion, one of the paying out core and the paying out rotor rotates with respect to the other, so that the rotor side engaging portion is inserted into the core side insertion recessed portion. A plurality of the butting portions are provided in positions different from each other in the mounting direction of the cartridge.

According to this configuration, when the cartridge is being mounted in the cartridge mounting section, it is restrained that at substantially the same time when one core side engaging portion butts against one butting portion, another core side engaging portion butts against another butting portion. Therefore, when one core side engaging portion butts against one butting portion, the paying out rotor can rotate, so that the rotor side engaging portion is inserted between the core side engaging portions without causing the rotor side engaging portion to hit against the core side engaging portion. Therefore, a user can smoothly mount the cartridge in the cartridge mounting section.

In this case, it is preferable that the rotor side engaging portion has a guide inclined surface provided more inside than the butting portion in a radial direction of the paying out rotor and at a position nearer than the butting portion in the mounting direction, and when the cartridge is being mounted in the cartridge mounting section, the guide inclined surface guides the paying out rotor butting against the guide inclined surface to outside in the radial direction of the paying out rotor.

According to this configuration, when the cartridge is being mounted in the cartridge mounting section, it is restrained that the core side engaging portion butts against the butting portion of the rotor side engaging portion in a state in which the center of the paying out core deviates from the center of the paying out rotor. Therefore, it can be restrained that at substantially the same time when one core side engaging portion butts against one butting portion, another core side engaging portion butts against another butting portion.

In this case, it is preferable that a plurality of the guide inclined surfaces are provided in positions different from each other in the mounting direction.

According to this configuration, it is restrained that at substantially the same time when one core side engaging portion butts against one guide inclined surface, another core side engaging portion butts against another guide inclined surface.

In this case, it is preferable that the paying out rotor has a chamfered portion formed by chamfering a corner portion in the opposite direction of the mounting direction.

According to this configuration, when the cartridge is being mounted in the cartridge mounting section, the paying out rotor is smoothly inserted into the paying out core.

In this case, it is preferable that the chamfered portion continues to the guide inclined surface provided farthest in the opposite direction of the mounting direction.

According to this configuration, when the cartridge is being mounted in the cartridge mounting section, the core side engaging portion butting against the chamfered portion is smoothly introduced onto the guide inclined surface.

The tape printing apparatus includes a cartridge mounting section where a cartridge including a paying out core around which an ink ribbon is wound and in which a plurality of core side engaging portions and a plurality of core side insertion recessed portions are alternately provided in a circumferential direction is mounted, a paying out shaft provided in the cartridge mounting section, a paying out rotor which is rotatably provided to the paying out shaft and is inserted into the paying out core when the cartridge is being mounted in the cartridge mounting section, a plurality of rotor side engaging portions which are provided on an outer circumferential surface of the paying out rotor so as to protrude in a radial direction and which engage with the plurality of core side engaging portions when the paying out rotor rotates, and a print head that holds the ink ribbon and a print tape between the print head and a platen roller and performs printing on the print tape. The plurality of rotor side engaging portions have an butting portion provided in an opposite direction of a mounting direction of the cartridge, and when the cartridge is being mounted in the cartridge mounting section, if the core side engaging portion provided in the mounting direction of the cartridge butts against the butting portion, at least one of the paying out core and the paying out rotor rotates, so that the rotor side engaging portion is inserted into the core side insertion recessed portion. A plurality of the butting portions are provided in positions different from each other in the mounting direction of the cartridge.

According to this configuration, when the cartridge is being mounted in the cartridge mounting section, it is restrained that at substantially the same time when one core side engaging portion butts against one butting portion, another core side engaging portion butts against another butting portion. Therefore, when one core side engaging portion butts against one butting portion, the paying out rotor can rotate, so that the rotor side engaging portion is inserted between the core side engaging portions without causing the rotor side engaging portion to hit against the core side engaging portion. Therefore, a user can smoothly mount the cartridge in the cartridge mounting section.

What is claimed is:

1. An ink ribbon feeding mechanism comprising:

a cartridge mounting section where a cartridge including a paying out core around which an ink ribbon is wound and in which a plurality of core side engaging portions and a plurality of core side insertion recessed portions are alternately provided in a circumferential direction is mounted;

a paying out shaft provided in the cartridge mounting section;

a paying out rotor which is rotatably provided to the paying out shaft and is inserted into the paying out core when the cartridge is being mounted in the cartridge mounting section; and a plurality of rotor side engaging portions which are provided on an outer circumferential surface of the paying out rotor so as to protrude in a radial direction and which engage with the plurality of core side engaging portions when the paying out rotor rotates, wherein the plurality of rotor side engaging portions have a butting portion provided near in a mounting direction of the cartridge, and when the cartridge is being mounted in the cartridge mounting section, if the core side engaging portion provided deep in the mounting direction of the cartridge butts against the butting portion, one of the paying out core and the paying out rotor rotates with respect to the other, so that the rotor side engaging portion is inserted into the core side insertion recessed portion, and a plurality of the butting portions are provided in positions different from each other in the mounting direction of the cartridge.

2. The ink ribbon feeding mechanism according to claim 1, wherein the rotor side engaging portion has a guide inclined surface provided more inside than the butting portion in a radial direction of the paying out rotor and at a position nearer than the butting portion in the mounting direction, and when the cartridge is being mounted in the cartridge mounting section, the guide inclined surface guides the paying out rotor butting against the guide inclined surface to outside in the radial direction of the paying out rotor.

3. The ink ribbon feeding mechanism according to claim 2, wherein a plurality of the guide inclined surfaces are provided in positions different from each other in the mounting direction.

4. The ink ribbon feeding mechanism according to claim 3, wherein the paying out rotor has a chamfered portion formed by chamfering a corner portion positioned near in the mounting direction.

5. The ink ribbon feeding mechanism according to claim 4, wherein the chamfered portion continues to the guide inclined surface provided nearest in the mounting direction.

6. A tape printing apparatus comprising:

a cartridge mounting section where a cartridge including a paying out core around which an ink ribbon is wound and in which a plurality of core side engaging portions and a plurality of core side insertion recessed portions are alternately provided in a circumferential direction is mounted;

a paying out shaft provided in the cartridge mounting section;

a paying out rotor which is rotatably provided to the paying out shaft and is inserted into the paying out core when the cartridge is being mounted in the cartridge mounting section;

a plurality of rotor side engaging portions which are provided on an outer circumferential surface of the paying out rotor so as to protrude in a radial direction and which engage with the plurality of core side engaging portions when the paying out rotor rotates; and a print head that holds the ink ribbon and a print tape between the print head and a platen roller and performs printing on the print tape, wherein the plurality of rotor side engaging portions have a butting portion provided in an opposite direction of a mounting direction of the cartridge, and when the cartridge is being mounted in the cartridge mounting section, if the core side engaging portion provided in the mounting direction of the cartridge butts against the butting portion, at least one of the paying out core and the paying out rotor rotates, so that the rotor side engaging portion is inserted into the core side insertion recessed portion, and a plurality of the butting portions are provided in positions different from each other in the mounting direction of the cartridge.

* * * * *